US006701123B2

(12) United States Patent
Endo et al.

(10) Patent No.: US 6,701,123 B2
(45) Date of Patent: Mar. 2, 2004

(54) CLEANING DEVICE WITH IMPROVED DAMPING MEMBER AND IMAGE FORMING APPARATUS USING THE SAME

(75) Inventors: Isao Endo, Hachioji (JP); Sachie Matsudaira, Hachioji (JP); Junichi Otani, Hachioji (JP); Toru Makino, Hachioji (JP); Chohiko Fukuo, Hachioji (JP); Kazuhiko Sato, Hachioji (JP); Fumitaka Mochizuki, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/205,113

(22) Filed: Jul. 25, 2002

(65) Prior Publication Data

US 2003/0035668 A1 Feb. 20, 2003

(30) Foreign Application Priority Data

Aug. 3, 2001 (JP) ..... 2001-236601
Aug. 3, 2001 (JP) ..... 2001-236602

(51) Int. Cl.[7] ..... G03G 21/00
(52) U.S. Cl. ..... 399/350; 399/351
(58) Field of Search ..... 399/350, 351

(56) References Cited

FOREIGN PATENT DOCUMENTS

JP 55-038540 * 3/1980
JP 56-091270 * 7/1981

* cited by examiner

*Primary Examiner*—Quana M. Grainger
(74) *Attorney, Agent, or Firm*—Muserlian, Lucas and Mercanti

(57) ABSTRACT

A cleaning device for cleaning a toner from a surface of a cylindrical latent image carrier having; a cleaning blade mechanism which includes a cleaning blade arranged so that a tip edge portion on a first surface of the cleaning blade contacts with the surface of the cylindrical latent image carrier, and a supporting member positioned on a second surface at a base end portion of the cleaning blade to urge the cleaning blade to contact with the surface of the cylindrical latent image carrier; and a laminar vibration-damping member whose base end portion is held by the supporting member on the second surface of the cleaning blade, wherein, on a tip end portion of the vibration-damping member, a plurality of slits are formed so that a plurality of tab portions are formed to be arranged in the axial direction of the cylindrical latent image carrier.

24 Claims, 9 Drawing Sheets

FIG. 14 ( a )
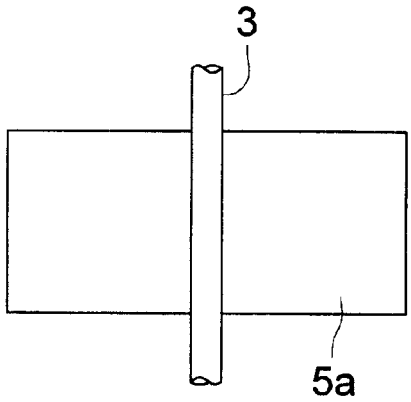
FIG. 14 ( b )
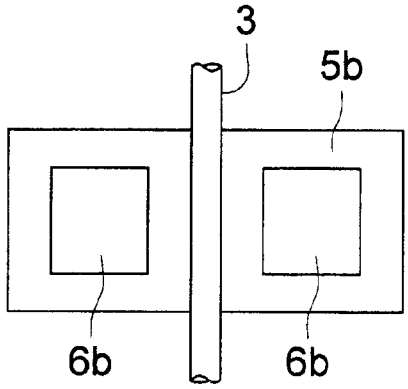
FIG. 14 ( c )
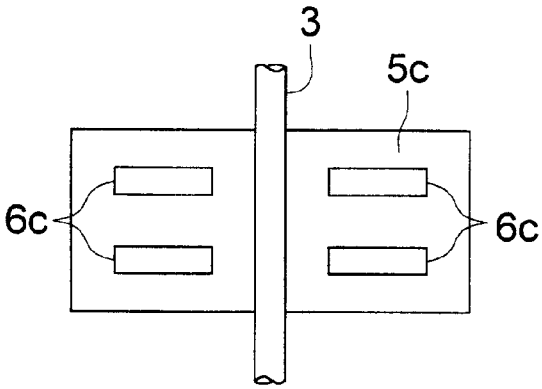
FIG. 14 ( d )
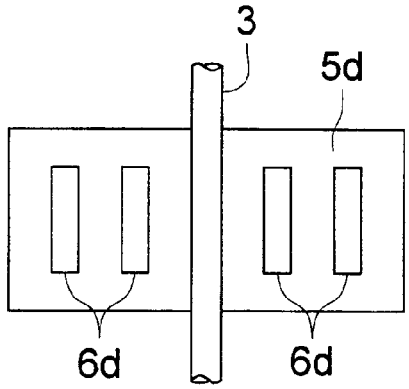

FIG. 15 ( a )
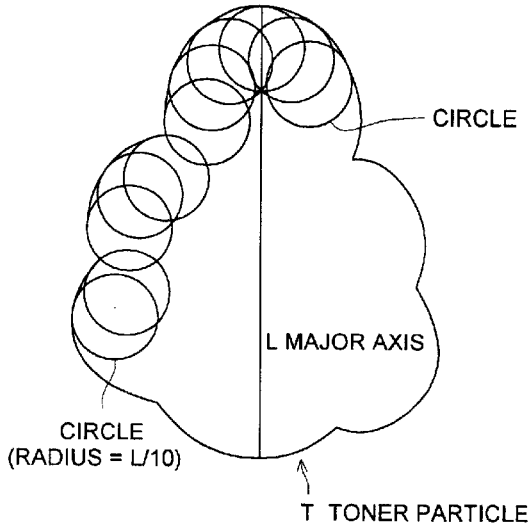
FIG. 15 ( b )
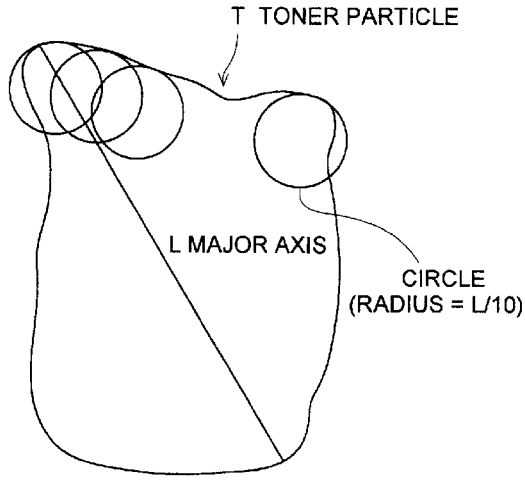
FIG. 15 ( c )
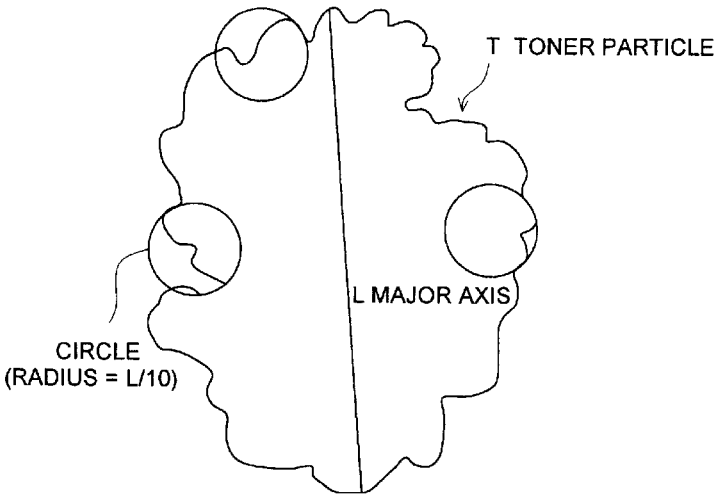

CLEANING DEVICE WITH IMPROVED DAMPING MEMBER AND IMAGE FORMING APPARATUS USING THE SAME

BACKGROUND OF THE INVENTION

The present invention relates to a cleaning device carried on, for example, an image forming apparatus of an electrophotographic system and to an image forming apparatus.

Presently, in an image forming apparatus of an electrophotographic system, for example, there is commonly used an image forming apparatus equipped with a latent image carrier composed of an organic photoreceptor containing organic photoconductive substances. The reason for this is as follows; that is, an organic photoreceptor has many advantageous points compared with other image carriers, including that materials coping with various exposure light sources covering a visible light through infrared radiation are easily developed, materials which cause no environmental pollution can be selected, and manufacturing cost is low.

In the image forming apparatus of this kind, there is known an image forming apparatus that is equipped, as a means to eliminate residual toner such as not-transferred toner or after-transfer-residual toner on an organic photoreceptor, with a cleaning device which is of a blade cleaning system to bring a flat cleaning blade made of an elastic object to be in contact with a surface of the organic photoreceptor and thereby to eliminate residual toner on the organic photoreceptor.

However, with regard to the organic photoreceptor, its mechanical strength is small, and thereby, deterioration or cracks on its surface are easily caused when making many prints, while, energy of contact with toner for visualizing an electrostatic latent image formed on the surface of the organic photoreceptor is great, and thereby, various problems described below are easily caused in the cleaning step to eliminate residual toner which has passed through a transfer area.

For example, because of the contact energy which is great, there are easily caused phenomena such as "blade eversion" which means that a tip edge of the cleaning blade that is in contact with a surface of the organic photoreceptor follows to move in the moving direction of the organic photoreceptor to be reversed, "blade bound" which means that the cleaning blade bounds on the surface of the organic photoreceptor, while being affected by the force acting in the direction to compress and deform the cleaning blade that is caused by movement of the organic photoreceptor, or "blade squeaking" which means that a minute vibration caused at a portion where the cleaning blade is in contact with the surface of the organic photoreceptor is resonant with the organic photoreceptor to produce high metallic sound.

On the other hand, in the image forming apparatus of an electrophotographic system, toner particles are now required to be small in size from the viewpoint of high image quality of an image, and a polymerization method such as, for example, an emulsion polymerization method or a suspension polymerization method is favorably used as a method to obtain the aforementioned toner particle.

However, adhesive power between toner particles and an organic photoreceptor becomes greater as toner particles are made to smaller, and thereby, removing of residual toner on the organic photoreceptor becomes more difficult, and when the so-called polymerization toner produced by the polymerization method is used, in particular, a form of a toner particle becomes to be closer to a spherical shape. Therefore, a toner particle rolls on the organic photoreceptor to cause easily a cleaning failure which means that the toner particle slips through the cleaning blade and is called the so-called "slipping-through", which causes a problem that it is more difficult to remove residual toner on the organic photoreceptor. In particular, the surface of the organic photoreceptor tends to be worn out, and when toner sticks to the unevenness on the surface generated by wear, slipping-through of a few toner is generated for a long time, and these toner particles which have slipped through contaminate charging members (charging wires and charging rollers), resulting in a problem that forming of images having high image quality is difficult.

For preventing occurrence of such cleaning failure, TOKKAIHEI No. 3-189675, for example, discloses a cleaning system wherein mechanical cleaning by a cleaning blade and electrostatic cleaning are used together.

To be concrete, in the structure of the cleaning system, a brush roller made of conductive material is installed at the position which is upstream side of the cleaning blade in the direction of movement of a latent image carrier, and on this brush roller, there is impressed appropriate-sized bias voltage whose polarity is opposite to that of residual toner on the latent image carrier, for example, and thereby, the cleaning efficiency has been improved by both a mechanical cleaning effect by means of a cleaning blade and an electrostatic cleaning effect by means of the brush roller.

However, in the image forming apparatus of the aforementioned structure, the greater part of residual toner on the latent image carrier are removed by the brush roller located at the upstream side in the direction of movement of the latent image carrier, and thereby, an amount of residual toner arriving at the cleaning blade is extremely small in many cases, thus, aforementioned blade eversion and blade squeaking tend to be caused, resulting in a problem that stable forming of images having high image quality for a long time is difficult.

Further, to prevent occurrence of cleaning failure like that stated above, it has been suggested to make the particle shape of toner to be used to be amorphous, for example, to make a form of a particle of toner to be a shape of an ellipse, or to make a surface shape of a particle of toner to be of an unevenness shape, but none of them has been a solution in the actual conditions.

The invention has been achieved based on the aforementioned circumstances, and its object is to provide a cleaning device which is provided with a cleaning blade and is capable of exhibiting high cleaning power stably for a long time.

Another object of the invention is to provide an image forming apparatus which is capable of removing surely residual toner on a latent image carrier and thereby is capable of forming stably images having high image quality for a long time.

SUMMARY OF THE INVENTION

The cleaning device of the invention is provided with a cleaning blade mechanism that comprises a cleaning blade arranged so that its tip edge may touch the surface of a cylindrical latent image carrier that is driven to rotate and a supporting member that is positioned on the outer surface of a base end portion of the cleaning blade to urge the cleaning blade to be in contact with the surface of the latent image carrier, and in the cleaning blade mechanism, there is provided a flexible and laminar vibration-damping member which is held at its base end portion by the supporting member to extend in the same direction as that of the cleaning blade, and on the tip end portion of the vibration-damping member, there are formed slit-shaped slits so that a plurality of tab portions may be formed in the axial direction of the latent image carrier, and a tip edge of the tab portion is positioned at the outer surface of the cleaning blade.

On the cleaning device of the invention, it is preferable that a ratio of the protruded length of the vibration-damping member extending beyond the tip edge of the supporting member to that of the cleaning blade extending beyond the tip edge of the supporting member is greater than 0.1 and is not more than 0.9.

On the cleaning device of the invention, it is preferable that a length of the tab portion of the vibration-damping member in the direction of the axis of the latent image carrier is within a range of 1/100–1/10 of the length of the cleaning blade in the axial direction, and it is further preferable that a depth of a slit formed on the tip end portion is in the size ranging from 1/10 to 1/1 of the protruded length of the vibration-damping member.

The image forming apparatus of the invention is characterized in that residual toner on the latent image carrier is removed by the aforementioned cleaning device at the position for a toner image formed by a toner image forming mechanism where the toner image has passed a transfer area where the toner image is transferred onto a recording material.

Further, on the image forming apparatus of the invention, it is preferable that toner used in the toner image forming mechanism satisfies one or two, or all of the following conditions (1)–(3).

(1) Toner composed of toner particles wherein a percentage of toner particles whose shape factor is within a range of 1.2–1.6 is 65 number % or more, and a variation coefficient of the shape factor is 16% or less.

(2) Toner composed of toner particles wherein a variation coefficient of the shape factor is 16% or less, and the number variation coefficient in number particle size distribution is 27% or less.

(3) Toner composed of toner particles wherein a percentage of toner particles having no corners is 50 number % or more.

Effect

In the cleaning device of the invention, a vibration of the cleaning blade is damped by and absorbed into a vibration-damping member, because the vibration-damping member having flexibility is in contact with the cleaning blade for the whole area of the latent image carrier in its axial direction, thus, it is possible to control the vibration of the cleaning blade to be small, without impeding original effect and function of the cleaning blade, and further it is possible to surely prevent occurrence of blade bound, blade eversion, blade squeaking or slipping-through of toner, because each tab portion can exhibit vibration-damping functions independently each other, which makes it possible to exhibit high cleaning effect for certain.

Even in the case of variation of pressing force of the cleaning blade against a photoreceptor caused by deformation of the cleaning blade that results from environmental fluctuations, the vibration-damping member follows the cleaning blade, and thereby, occurrence of great variation of contact load of the cleaning blade against the latent image carrier is repressed, thus, occurrence of blade bound, blade eversion, blade squeaking or slipping-through of toner can be prevented surely, and expected cleaning effect can be exhibited stably despite the environmental fluctuations.

In the image forming apparatus of the invention wherein the aforementioned cleaning device is provided, it is possible to prevent surely occurrence of blade squeaking, blade bound or blade eversion, and to exhibit stable cleaning effect for environmental fluctuations, and therefore, it is possible to remove residual toner on the latent image carrier for certain, and to form stably images having high image quality for a long time.

In the second structure of the cleaning device of the invention, there are provided a cleaning blade mechanism having a cleaning blade arranged so that its tip edge may touch the surface of a cylindrical latent image carrier that is driven to rotate, a cleaning roller mechanism having a cleaning roller that is arranged so that it may touch the surface of the latent image carrier at the position which is upstream side of the cleaning blade in the direction of movement of the latent image carrier and may rotate around the rotary shaft extending in the axial direction of the latent image carrier, and a bias voltage impressing means that impresses bias voltage on the cleaning roller, and in the cleaning blade mechanism, a supporting member that is positioned on the outer surface of a supporting member that is positioned on the outer surface of a base end portion of the cleaning blade to urge the cleaning blade to be in contact with the surface of the latent image carrier, and there is provided a flexible and laminar vibration-damping member which is held at its base end portion by the supporting member to extend in the same direction as that of the cleaning blade, while on the tip end portion of the vibration-damping member, there are formed slit-shaped slits so that a plurality of tab portions may be formed in the axial direction of the latent image carrier, and a tip edge of the tab portion is positioned at the outer surface of the cleaning blade.

On the second structure of the cleaning device of the invention, it is preferable that a ratio of the protruded length of the vibration-damping member extending beyond the tip edge of the supporting member to that of the cleaning blade extending beyond the tip edge of the supporting member is greater than 0.1 and is not more than 0.9.

On the second structure of the cleaning device of the invention, it is preferable that a length of the tab portion of the vibration-damping member in the direction of the axis of the latent image carrier is within a range of 1/100–1/10 of the length of the cleaning blade in the axial direction, and it is further preferable that a depth of a slit formed on the tip end portion is in the size ranging from 1/10 to 1/1 of the protruded length of the vibration-damping member.

Further, it is preferable that a bias voltage impressing means is a constant-current power supply.

In the second structure of the image forming apparatus of the invention, there are provided a cylindrical latent image carrier that is driven to rotate, a toner image forming mechanism that forms a toner image on the latent image carrier with toner, and a cleaning device that removes residual toner on the latent image carrier at the position for the toner image on the latent image carrier to be transferred onto a recording material, and the cleaning device is provided with a cleaning blade mechanism having a cleaning blade arranged so that its tip edge may touch the surface of a latent image carrier, a cleaning roller mechanism having a cleaning roller that is arranged so that it may touch the surface of the latent image carrier at the position which is upstream side of the cleaning blade in the direction of movement of the latent image carrier and may rotate around the rotary shaft extending in the axial direction of the latent image carrier, and with a bias voltage impressing means that impresses bias voltage on the cleaning roller, while, in the cleaning blade mechanism, a supporting member that is positioned on the outer surface of a supporting member that is positioned on the outer surface of a base end portion of the cleaning blade to urge the cleaning blade to be in contact with the surface of the latent image carrier, and there is provided a flexible and laminar vibration-damping member which is held at its base end portion by the supporting member to extend in the same direction as that of the cleaning blade, and on the tip end portion of the vibration-damping member, there are formed slit-shaped slits so that a plurality of tab portions may be formed in the axial direction of the latent image carrier, and a tip edge of the tab portion is positioned at the outer surface of the cleaning blade.

On the second structure of the image forming apparatus of the invention, it is preferable that a ratio of the protruded length of the vibration-damping member extending beyond the tip edge of the supporting member to that of the cleaning blade extending beyond the tip edge of the supporting member is greater than 0.1 and is not more than 0.9.

On the second structure of the image forming apparatus of the invention, it is preferable that a length of the tab portion of the vibration-damping member in the direction of the axis of the latent image carrier is within a range of 1/100–1/10 of the length of the cleaning blade in the axial direction, and it is further preferable that a depth of a slit formed on the tip end portion is in the size ranging from 1/10 to 1/1 of the protruded length of the vibration-damping member.

It is further preferable that a bias voltage impressing means is a constant-current power supply.

Further, on the second structure of the image forming apparatus of the invention, it is preferable that toner used in the toner image forming mechanism satisfies one or two, or all of the following conditions (1)–(3).

(1) Toner composed of toner particles wherein a percentage of toner particles whose shape factor is within a range of 1.2–1.6 is 65 number % or more, and a variation coefficient of the shape factor is 16% or less.

(2) Toner composed of toner particles wherein a variation coefficient of the shape factor is 16% or less, and the number variation coefficient in number particle size distribution is 27% or less.

(3) Toner composed of toner particles wherein a percentage of toner particles having no corners is 50 number % or more.

In the second structure of the cleaning device of the invention, mechanical cleaning by a cleaning blade is carried out in addition to electrostatic cleaning by the cleaning roller mechanism, and basically high cleaning effect is exhibited, and residual toner on the latent image carrier can surely be removed accordingly.

Further, in the cleaning blade mechanism, a vibration-damping member having flexibility is in contact with a cleaning blade for the whole area of the cleaning blade in its lateral direction, and therefore, a vibration of the cleaning blade is damped by and absorbed into a vibration-damping member, and it is possible to control the vibration of the cleaning blade to be small, and to surely prevent occurrence of blade bound, blade eversion, blade squeaking or slipping-through of toner, without impeding original effect and function of the cleaning blade, because each tab portion can exhibit vibration-damping functions independently each other, which makes it possible to exhibit high cleaning effect for certain.

Figure 1:
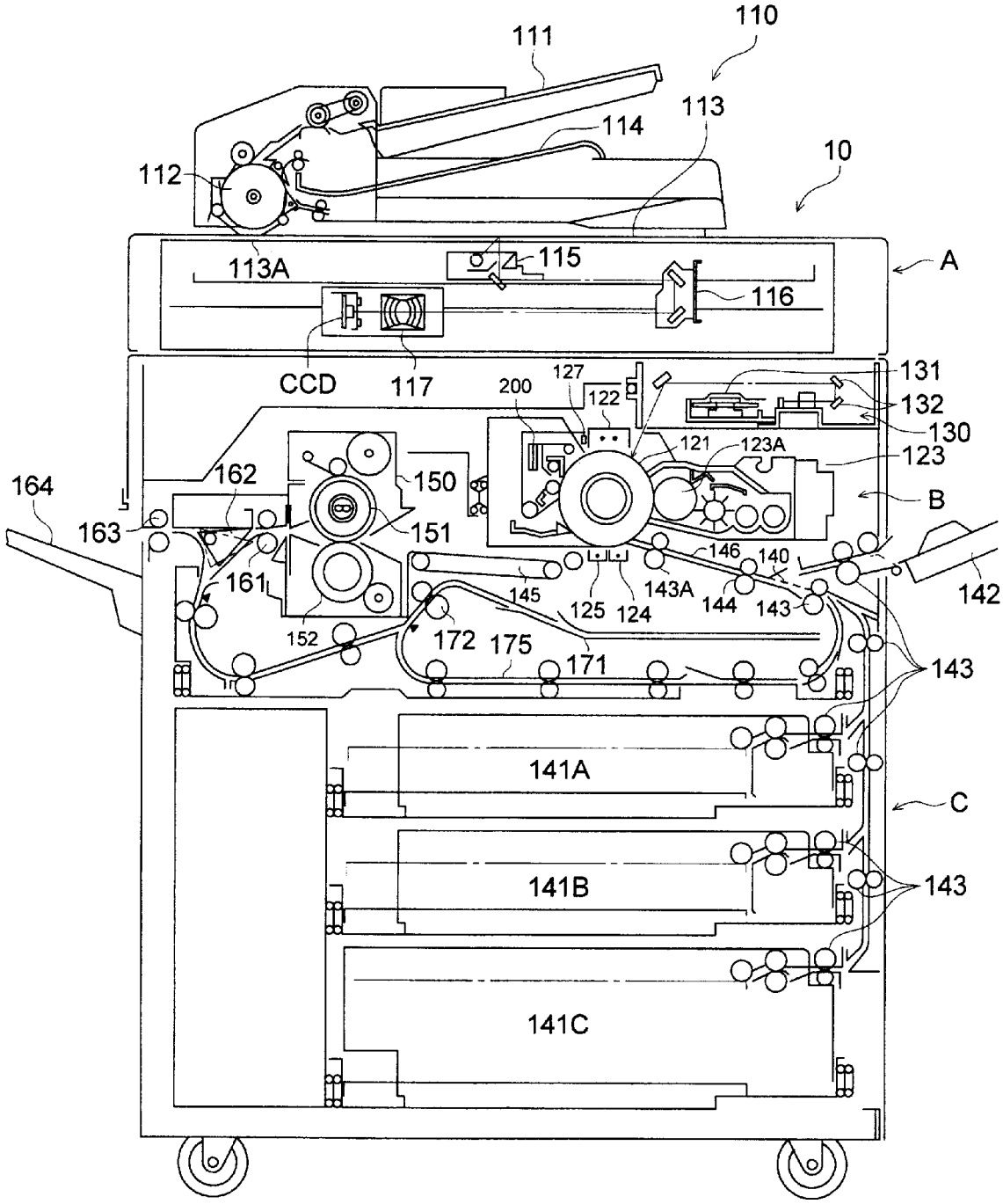
FIG. 1 is a schematic structural diagram showing the overall structure of an image forming apparatus of the invention.

Each of FIG. 14(*a*)–FIG. 14(*d*) is a schematic diagram showing a concrete example of an impeller shape.

FIG. 15(*a*) is an illustration showing a projected image of a toner particle having no corner, while FIG. 15(*b*) and FIG. 15(*c*) represent an illustration showing a projected image of toner particle having corners.

DETAILED DESCRIPTION OF THE PREFERRED EMBODIMENT

The invention will be explained in detail as follows, referring to the drawings.

FIG. 1 is an illustration showing a schematic structure in an example of an image forming apparatus of the invention.

Image forming apparatus 10 is provided with image reading section A that reads images of a document, an image processing section (not shown) that conducts processing of document image information obtained by the image reading section A through its reading, image forming section B that forms an image based on document image information processed by the image processing section, and recording material conveying section C representing a recording material conveying means that supplies to the image forming section a recording material for recording thereon the image formed in the image forming section B, for example, a transfer sheet.

On top of image reading section A, there is provided automatic document feeder 110 that feeds a document automatically, and each of documents placed on the document loading plate 111 is separated and conveyed by document conveyance roller 112, then, images on the document are read at reading position 113A, and the document is ejected on document ejection tray 114 by the document conveyance roller 112.

On the other hand, when a document is placed on platen glass 113, images of the document are read by the following two reading actions; one reading action is executed when first mirror unit 115 composed of an illumination lamp and a first mirror constituting a scanning optical system is moved in the horizontal direction (direction from side to side in the drawing) at a speed of v, and the other reading action is executed when second mirror unit 116 that is composed of a second mirror and a third mirror both arranged to be in a V-shape is moved in the same direction as in the first mirror unit 115 at a speed of v/2.

Images of the document thus read are formed as images on a light-receiving surface of imaging element CCD representing a line sensor through projection lens 117. Linear optical images thus formed on the imaging element CCD are subjected to analog-to-digital conversion after they are converted photoelectrically into electric signals (luminance signals) in succession, then, they are subjected to density conversion and processing such as filter processing at an image processing section, and are stored temporarily in a memory as document image information.

In image forming section B, there are provided drum-shaped photoreceptor 121 representing a latent image carrier that is driven to rotate and a toner image forming mechanism (unit) that is composed of charging unit 122, developing unit 123, transfer unit 124, separation unit 125, cleaning unit 200 and pre-charge lamp (PCL) 127 which are arranged along the outer circumference of the photoreceptor 121 in the order of their operations in the rotary direction of the photoreceptor 121. The photoreceptor 121 in the illustrated example is driven to rotate in, for example, the clockwise direction.

In the toner image forming mechanism, the surface of the photoreceptor 121 is charged uniformly to be in a prescribed polarity (for example, negative polarity) by the charging unit 122, then, is exposed to light by exposure optical system 130 based on document image information called from the memory in the image processing section.

To be concrete, the surface of the photoreceptor 121 is selectively exposed to light by main scanning that is carried out when a laser beam from a light source composed of, for example, a laser diode (not shown) irradiated through polygon mirror 131 to be rotated, f θ lens (having no symbol) and a cylindrical lens (having no symbol) is deflected in terms of its optical path by reflection mirror 132, and by sub-scanning that is carried out when the photoreceptor 121 is rotated, and thereby, voltage on the irradiated portion (exposure area) on the surface of the photoreceptor 121 is lowered, thus, an electrostatic latent image corresponding to document images is formed. In an example of the present embodiment, an area of characters in document images, for example, is exposed to light, and an electrostatic latent image is formed.

Then, the surface of developing sleeve 123A provided through a developing area with the photoreceptor 121 is charged by developing bias impressed by an unillustrated power supply to be in the same polarity (for example, negative polarity) as that in the surface voltage on the photoreceptor 121, and developing agent including toner charged to be in the same polarity (for example, negative polarity) as that in the surface voltage on the developing sleeve 123A is conveyed to the developing area. Surface voltage (Vh) on the non-exposure area of the photoreceptor 121, surface voltage (V1) on the exposure area of the photoreceptor 121 and surface voltage (Vd) on the developing sleeve 123A are the same in terms of polarity, and with respect to their absolute values, (Vh)>(Vd)>(V1) holds, and on the developing area, therefore, toner on the developing sleeve 123A sticks to the exposure area on the photoreceptor 121, thus, reversal development is carried out, and a toner image that is a visible image is formed on the surface of the photoreceptor 121.

On the other hand, in recording material conveyance section C located under the toner image forming mechanism, there are provided sheet feed units 141A, 141B and 141C each representing a recording material loading means wherein transfer sheets having a different size are loaded, and on one side, there is provided manual bypass sheet feed unit 142 for hand feeding. A transfer sheet is fed from the selected sheet feed unit by guide roller 143 along conveyance path 140, and is synchronized, by paired registration rollers 144 which correct inclination and shifting of the transfer sheet, with the toner image formed on the photoreceptor 121 to be conveyed to transfer area T in image forming section B through conveyance path 140, pre-transfer roller 143A and transfer-approach guide plate 146.

Then, in the transfer area T, the toner image on the photoreceptor 121 is transferred onto a transfer sheet by transfer unit 124, and the transfer sheet on which the toner image has been transferred is neutralized by separation unit 125 to be separated from the surface of the photoreceptor 121. After that, the transfer sheet is conveyed to fixing unit 150 by conveyance unit 145 to be fixed.

The fixing unit 150 is equipped with fixing roller 151 and pressure roller 152 that is pressed by the fixing roller 151 to form a fixing area, thus, unfixed toner image on the transfer sheet is fixed, for example, by heat and pressure, and a visible image corresponding to a document image is formed on the transfer sheet.

Then, the transfer sheet on which the visible image is formed is ejected by ejection roller 161 from fixing unit 150 to be conveyed to reversing conveyance path by guide 162, or the transfer sheet is conveyed to first reversing conveyance path 171 when a visible image is formed on only one side of the transfer sheet. When reversing roller 172 is rotated reversely, the transfer sheet is conveyed toward an ejection outlet, and is ejected by ejection roller 163 onto ejection tray 164 with the surface having thereon a visible image facing downward.

On the other hand, when forming visible images on both sides of a transfer sheet, the transfer sheet is conveyed to the reversing conveyance path by guide 162 after being ejected from fixing unit 150, and in this case, the transfer sheet is conveyed by reversing roller 172 to second reversing conveyance path 175 with the surface having thereon a visible image facing upward. Then, the transfer sheet is conveyed again toward transfer area T in image forming section B so that a visible image is formed on the other side of the transfer sheet.

Thus, the transfer sheet having visible images on both sides thereof is ejected onto ejection tray 164 through ejection roller 163 with the surface on which the visible image was formed first facing downward.

In the foregoing, the photoreceptor 121 from which the toner image has been transferred onto a transfer sheet is subjected to the cleaning step where residual toner staying on the surface of the photoreceptor 121 is removed by cleaning unit 200.

Figure 2:
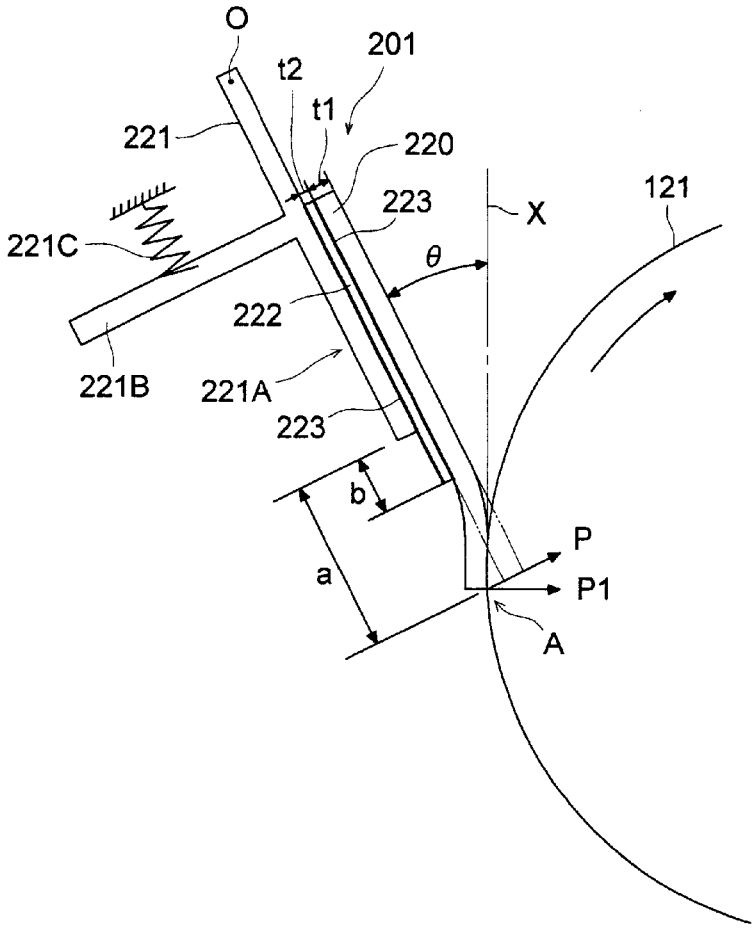
FIG. 2 is a side view for illustration showing an example of structure of a cleaning device of the invention.

FIG. 2 is a side view for illustration showing an outline of the first structure of a cleaning device of the invention.

Cleaning unit 200 is equipped with cleaning blade mechanism 201 which is composed of sheet-shaped cleaning blade 220 provided so that it extends in the axial direction of the cylindrical photoreceptor 121 driven to rotate and its tip edge may touch the surface of the photoreceptor 121 and of a supporting member that is positioned on the outer surface (the surface positioned on the left side in FIG. 2) of a base end portion of the cleaning blade 220 to support the cleaning blade and rotates around rotary central axis O extending to be in parallel with a rotary shaft of the photoreceptor 121 to urge the cleaning blade 220 to be in contact with the surface of the photoreceptor 121.

The cleaning blade 220 is in the state to be inclined outward against tangential plane X at contact position A on the surface of the photoreceptor 121. In the state of operation, the cleaning blade 220 is brought into pressure contact with the surface of the photoreceptor 121 under the condition that the cleaning blade 220 is totally curved so that the tip portion of the cleaning blade may point to the direction opposite to the direction of rotation of the photoreceptor 121 (counter direction), and a contact pressure on the surface of the photoreceptor 121 is controlled to be on the certain level. In this case, it is preferable that the tip portion of the cleaning blade 220 is arranged to be in the state to form a pressure contact area on the surface of the photoreceptor 121.

The cleaning blade 220 can be made of, for example, a rubber elastic object, and as a rubber elastic object, there are given, for example, urethane rubber, silicone rubber, fluorine rubber, chloroprene rubber and butadiene rubber. Among these, urethane rubber is used preferably because it is excellent in abrasion resistance.

As urethane rubber, it is preferable to use one obtained by conducting reaction hardening for polycaprolacton and polyisocyanate both disclosed in, for example, TOKKAI-SHO No. 59-30574.

The supporting member 221 is composed of sheet-shaped blade supporting section 221A whose base end portion is fixed rotatably on an apparatus frame (not shown) and of sheet-shaped pressing force urging section 221B that extends in the direction perpendicular to the blade supporting section 221A at the location closer to the tip side than rotary central axis O of the blade supporting section 221A, and on the pressing force urging section 221B, there is provided pressing means 221C such as a coil spring whose one end is fixed on an apparatus frame.

On the cleaning blade mechanism 201, there is provided flexible and sheet-shaped vibration-damping member 222 whose base end portion is held by the supporting member 221, and extends in the same direction (axial direction of photoreceptor 121) as the cleaning blade 220.

To be concrete, a base end portion of the vibration-damping member 222 is interposed between the cleaning blade 220 and blade supporting section 221A in supporting member 221, and the vibration-damping member 222 is arranged under the condition that a tip side portion is extended to exceed a tip edge of blade supporting section 221A of supporting member 221 and a tip edge is in contact with an outer surface of cleaning blade 220, to be fixed integrally, by adhesive agents 223, to an outer surface of the cleaning blade 220 and an inner surface of the blade supporting section 221A excluding a portion protruding beyond the tip edge of the blade supporting section 221A.

There is no limitation, in particular, for materials having flexibility of which the vibration-damping member 222 is made, provided that the materials can control elastic deformation of the cleaning blade 220 and are harder than the cleaning blade 220 to the extent wherein excessively great pressing force is not applied to photoreceptor 121, and for example, various materials such as plastic member, metal member or hard rubber can be used.

In this case, as an extent of "flexibility", it is preferable that the bending strength measured under the standard of JIS K-7203 is 1–500 $N/mm^2$.

The plastic member is one made of polymeric material which can be formed to be in any form by heating, and as polymeric materials, there are preferably used, for example, polyethylene terephthalate resin, polystyrene resin, polyacrylate resin, polyethylene resin, polypropylene resin, polyallylate resin, thermoplastic resin such as styrene acrylate copolymer resin, reinforced plastic such as glass-fiber-reinforced plastic or carbon-fiber-reinforced plastic, or thermosetting polymeric materials hardened by three-dimensional cross linkage and having small rubber elasticity.

As a metal member, it is possible to use, for example, lamina of phosphor bronze, of stainless steel (SUS) or of iron.

Further, types of hard rubber are not limited, and various hard rubber can be used.

Figure 3:
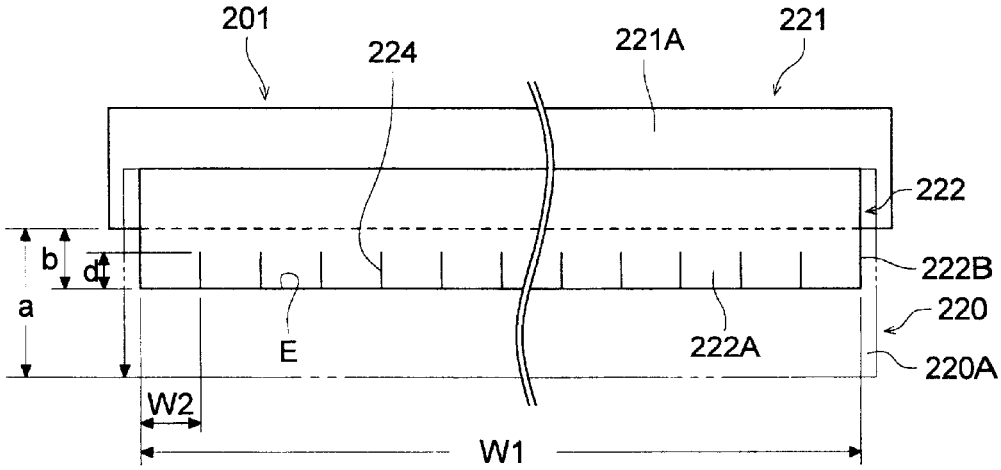
FIG. 3 is a plan view showing an example of structure of a cleaning blade mechanism.

The vibration-damping member 222 is one having on its tip portion a plurality of tab portions arranged in the axial direction of photoreceptor 121, and it is composed of a sheet-shaped member on which a plurality of tab portions 222A are formed by forming slit-shaped slits 224 from tip edge E in the direction (vertical direction in FIG. 3) perpendicular to the axial direction of photoreceptor 121 at positions each being away from others in the axial direction (direction from side to side in FIG. 3) of photoreceptor 121 as shown, for example, in FIG. 3.

With regard to the vibration-damping member 222, a length of a portion which is not fixed by the blade supporting section 221A of supporting member 221, namely, length of protruded portion 222B extending beyond the tip edge of the blade supporting section 221A (hereinafter referred to as "protrusion length") "b" is smaller than length of protruded portion 220A of cleaning blade 220 "a".

When the protrusion length "b" of the vibration-damping member 222 is smaller than the protrusion length "a" of the cleaning blade 220, a vibration of the cleaning blade 220 is damped by the vibration-damping member 222 without basic control of deformation (deformation caused by pressure contact of photoreceptor 121) of the cleaning blade 220, thus, it is possible to impede surely the vibration of the cleaning blade 220 to be small, and to prevent occurrence of blade squeaking for certain.

It is preferable that the ratio (b/a) of the protrusion length "b" of the vibration-damping member 222 to the protrusion length "a" of the cleaning blade 220 is greater than 0.1 and is not more than 0.9, and it is more preferable to be within a range of 0.3–0.8.

When the ratio (b/a) of the protrusion length "b" of the vibration-damping member 222 to the protrusion length "a" of the cleaning blade 220 is not more than 0.1, "slipping-through" of toner and blade squeaking tend to be caused, while, when the ratio (b/a) of the protrusion length "b" of the vibration-damping member 222 to the protrusion length "a" of the cleaning blade 220 is greater than 0.9, on the other hand, blade eversion and blade bound tend to be caused.

A preferable range of the ratio (t2/t1) of thickness t2 of the vibration-damping member 222 to thickness t1 of the cleaning blade 220 varies depending on the materials for the vibration-damping member 222. In this case, each of "thickness t1 of the cleaning blade 220" and "thickness t2 of the vibration-damping member 222" shows a size in the direction perpendicular to the surface of joint with the supporting member 221 (see FIG. 2).

When the vibration-damping member 222 is composed of a plastic member, it is preferable that the ratio (t2/t1) of thickness t2 of the vibration-damping member 222 to thickness of t1 of the cleaning blade 220 is greater than 1/50 and is smaller than 1, and it is more preferable to be within a range of 1/50–1/4.

When the ratio (t2/t1) of thickness t2 of the vibration-damping member 222 to thickness of t1 of the cleaning blade 220 satisfies the aforementioned range, the cleaning blade 220 is stably held by the supporting member 221, and a vibration of the cleaning blade 220 is surely damped by the vibration-damping member 222, thus, occurrence of blade eversion and slipping-through of toner can be prevented surely, and expected cleaning effect can be exhibited for certain.

Further, when the ratio (t2/t1) is not more than 1/50, slipping-through of toner tends to be caused, while, when the ratio (t2/t1) is 1 or more, blade eversion tends to be caused.

When the vibration-damping member 222 is constructed by a metal lamina, it is preferable that the thickness of the vibration-damping member 222 is 50–500 $\mu$m. Due to this, sufficient flexibility is given to the vibration-damping member 222, and occurrence of slipping-through of toner and blade eversion can surely be prevented.

When the vibration-damping member 222 is constructed by hard rubber, it is preferable that the ratio (t2/t1) of thickness t2 of the vibration-damping member 222 to thickness t1 of the cleaning blade 220 is greater than 1/30 and is smaller than 2, while, it is more preferable to be within a range of 1/8–5/4 and is especially preferable to be within a range of 1/4–3/4.

When the ratio (t2/t1) of thickness t2 of the vibration-damping member 222 to thickness of t1 of the cleaning blade 220 satisfies the aforementioned range, the cleaning blade 220 and the vibration-damping member 222 made of hard rubber are stably held by the supporting member 221, and a vibration of the cleaning blade 220 is surely damped by the vibration-damping member 222, thus, occurrence of blade eversion and slipping-through of toner can be prevented surely, and expected cleaning effect can be exhibited for certain.

Further, when the ratio (t2/t1) is not more than 1/30, slipping-through of toner tends to be caused, while, when the ratio (t2/t1) is 2 or more, blade eversion tends to be caused.

Length (hereinafter referred to as "axial direction length" W2 of tab portion 222A in the vibration-damping member 222 in the axial direction of photoreceptor 121, namely, an interval of slit 224 to be formed in the sheet-shaped member is preferably 1/100–1/10 of length W1 of cleaning blade 220 in the axial direction (see FIG. 3).

When the ratio (w2/w1) of axial direction length W2 of tab portion 222A to axial direction length W1 of cleaning blade 220 is smaller than 1/100, warping deformation of vibration-damping member 222 caused by environmental fluctuations tends to be caused, and pressing force of the cleaning blade 220 against photoreceptor 121 is lowered to worsen close contact between the cleaning blade 220 and the photoreceptor 121, resulting in occasional occurrence of blade squeaking and slipping-through of toner.

On the other hand, when the ratio (W2/W1) of axial direction length W2 of tab portion 222A to axial direction length W1 of the cleaning blade 220 is greater than 1/10, pressing force of the cleaning blade 220 against photoreceptor 121 becomes excessive, thus, practical impact resilience of the cleaning blade 220 is lowered, and protruded length becomes small, resulting in occasional occurrence of blade bound.

It is preferable that depth (hereinafter referred to as "slit depth") d of slit 224 to be formed on the sheet-shaped member constituting the vibration-damping member 222 is 1/10–1/1 of protruded length b of the vibration-damping member 222 (see FIG. 3).

When the ratio (d/b) of slit depth d to protrusion length b of the vibration-damping member 222 is smaller than 1/10, pressing force of the cleaning blade 220 against photoreceptor 121 becomes great excessively, thus, practical impact resilience of the cleaning blade 220 is lowered, and protruded length becomes small, resulting in occasional occurrence of blade bound.

On the other hand, when the ratio (d/b) of slit depth d to protrusion length b of the vibration-damping member 222 is greater than 1, the surface of joint with the supporting member 221 becomes small, and sticking strength between the vibration-damping member 222 and the supporting member 221 becomes insufficient accordingly, resulting in a decline of pressing force of the cleaning blade 220 against photoreceptor 121 and occasional occurrence of slipping-through of toner.

A shape of each tab portion 222A is not restricted in particular, and it is not necessary that all tab portions are formed to be of the same length in the axial direction. It is further unnecessary that all slits each forming each tab portion 222A are in the same length.

Further, it is not necessary that each tab portion 222A is in contact with the cleaning blade 220 continuously along the total area in the axial direction of photoreceptor 121, but it is preferable that tab portions are in contact with the cleaning blade 220 for the length of 50% or more of axial direction length W1.

Examples of the numerical values in the cleaning blade mechanism stated above are as follows. Protrusion length "a" of the cleaning blade 220 is 6–15 mm, thickness "t1" is 0.5–10 mm, axial direction length "W1" is 200–600 mm, protrusion length "b" of vibration-damping member 222 is 0.6–13.5 mm, thickness "t2" is 0.01–2 mm, axial direction length "W2" of tab portion 222A is 0.1–100 mm and slit depth "d" that forms tab portion 222A is 0.1–10 mm.

It is preferable that contact load of the cleaning blade 220 against photoreceptor 121 is 5–40 N/m. When the contact load is smaller than 5 N/m, cleaning force becomes insufficient, and image smudge tends to be caused. When the contact load is greater than 40 N/m, on the other hand, wear of photoreceptor 121 grows greater, and image blur tends to be caused.

Contact load P1 is a vector value in the direction of a normal line for pressure contact force P generated when the cleaning blade 220 is brought into contact with the photoreceptor 121 (see FIG. 2). Methods for measuring the contact load include, for example, a method to measure by bringing a tip edge of the cleaning blade 220 into pressure contact with a pair of scales and a method to measure electrically by arranging a sensor such as a load cell at contact position A where a tip edge of the cleaning blade 220 touches photoreceptor 121.

Contact angle θ of the cleaning blade 220 on photoreceptor 121 is preferably 5–35°. When the contact angle θ is smaller than 5°, cleaning force is lowered and image smudge tends to be caused. When the contact angle θ is greater than 35°, there is easily caused blade eversion which means that a tip edge of the cleaning blade 220 follows photoreceptor 121 to be reversed.

The contact angle θ is an angle formed by tangential plane X to photoreceptor 121 at contact position A where a tip edge of the cleaning blade 220 touches the photoreceptor 121 and the cleaning blade before deformation (shown with chain lines in FIG. 2).

It is preferable that the cleaning blade 220 has JIS A hardness of 55–90 at 25±5° C. When JIS A hardness is smaller than 55, the cleaning blade 220 is too soft and blade eversion tends to be caused, and it is difficult to obtain sufficient cleaning power. When JIS A hardness is greater than 90, on the other hand, it is difficult to obtain sufficient follow-up property for slight unevenness on photoreceptor 121 and for foreign substances, and slipping-through of toner tends to be caused.

In this case, JIS A hardness is one obtained by measuring under the standard of JIS K-6253.

It is preferable that impact resilience of the cleaning blade 220 is 25–80%. When the impact resilience is greater than 80%, blade eversion tends to be caused, and when the impact resilience is smaller than 25%, on the other hand, it is difficult to obtain sufficient cleaning power. In this case, the impact resilience is one obtained by measuring under the standard of JIS K-6255.

Further, Young's modulus of the cleaning blade 220 is preferably 294–588 N/cm$^2$.

With regard to the cleaning blade 220, an edge portion thereof which touches photoreceptor 121, for example, may be coated with fluorine type lubricant if necessary, and it may further be coated with dispersed substance wherein fluorine type polymer and fluorine type resin power are dispersed in a fluorine type solvent.

In the aforementioned cleaning device, vibration-damping member 222 touches cleaning blade 220 for the total area in the direction of a width of the cleaning blade 220 without controlling basically an elastic deformation of the cleaning blade 220, and therefore, vibration of the tip portion of the cleaning blade 220 is damped surely, and thereby, the vibration of the cleaning blade 220 can be restrained to be small.

Moreover, each tab portion 222A exhibits a vibration-damping function independently each other, and thereby, it is possible to prevent surely occurrence of blade bound, blade eversion, blade squeaking or sipping-through of toner, without impeding original action and function of the cleaning blade 220, thus, a high cleaning effect can surely be exhibited.

Even in the case of fluctuations of pressing force of the cleaning blade 220 against photoreceptor 121 caused by deformation of the cleaning blade 220 originating from environmental variations, vibration-damping member 222 follows the cleaning blade 220, and thereby, heavy fluctuations of contact load of the cleaning blade 220 against photoreceptor 121 can be restrained, thus, occurrence of blade bound, blade eversion, blade squeaking or slipping-through of toner can be prevented surely, and expected cleaning effect can be exhibited stably despite environmental fluctuations.

In the conventional cleaning device, an optimum pressure contact condition of cleaning blade 220 for the surface of photoreceptor 121 has been determined by the delicate balance of various characteristics, and a range of the optimum pressure contact condition has been narrow considerably. Therefore, accuracy that is sufficiently high has been required for setting the pressure contact condition in the course of manufacturing the cleaning device, and on top of that, it has been unavoidable for a thickness of cleaning blade 220 to have dispersion, thus, a condition has not always been set to be optimum, and the condition sometimes comes off the appropriate area. In particular, when combining with an organic photosensitive layer employing high molecular binder resin, occurrence o blade eversion and slipping-through of toner becomes remarkable.

However, in the aforementioned cleaning device 200, a vibration of the cleaning blade 220 is surely damped by vibration-damping member 222 even when a thickness of the cleaning blade 220 has dispersion, and the pressure contact condition of the cleaning blade 220 for photoreceptor 121 can be maintained surely in an appropriate area, which makes it extremely easy to set the pressure contact condition for manufacturing of cleaning device 200.

Therefore, in image forming apparatus 10 having therein the cleaning device 200 stated above, occurrence of blade squeaking, blade bound or blade eversion is surely prevented, stable cleaning effect can be exhibited for environmental fluctuations, and therefore, residual toner on photoreceptor 121 can surely be removed, and images having high image quality can be formed stably for a long time.

Figure 4:
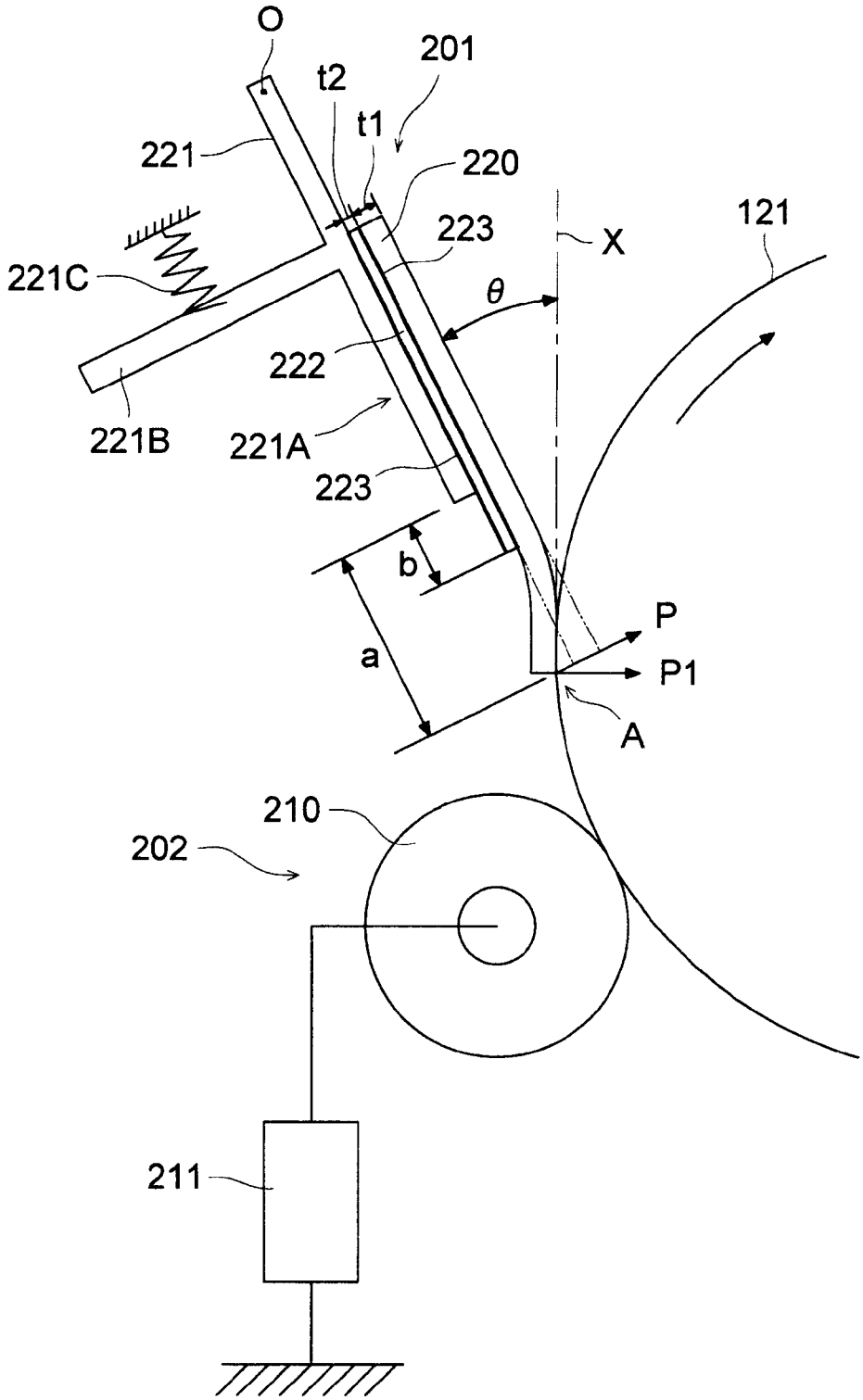
FIG. 4 is a side view for illustration showing an example of structure of a cleaning device of the invention.

FIG. 4 is a side view for illustration showing an outline of the second structure of a cleaning device of the invention.

This cleaning device 200 is equipped with cleaning blade mechanism 201 having sheet-shaped cleaning blade 220 that extends in the axial direction of cylindrical photoreceptor 121 driven to rotate, and is arranged so that its tip edge may touch the surface of photoreceptor 121, cleaning roller mechanism 202 having cleaning roller 210 that is arranged to be in contact with the surface of photoreceptor 121 at the position which is upstream side of cleaning blade 220 in the cleaning blade mechanism 201 in the direction of movement of photoreceptor 121, and to rotate around the rotation axis extending in the axial direction of photoreceptor 121, and bias voltage impressing means 211 that impresses bias voltage on the cleaning roller 210.

Cleaning blade 220 and cleaning blade mechanism 201 are the same as those in the aforementioned first structure.

Cleaning roller 210 is composed of an elastic object from the viewpoint of obtaining excellent state of contact with photoreceptor 121, and as a material of the elastic object, rubber materials such as silicone rubber and polyurethane which have been known, foaming object or foaming object covered with resin may be used.

It is preferable that the cleaning roller 210 is conductive or semi-conductive, and its surface electrical resistance is $10^2$–$10^{10}$ Ωcm. When the surface electrical resistance is smaller than $10^2$ Ωm, banding caused by electric discharge tends to be caused. When the it is greater than $10^{10}$ Ωcm, on the other hand, potential difference that is sufficiently large to remove toner cannot be obtained, and cleaning failure tends to be caused.

Surface electrical resistance of cleaning roller 210 can be adjusted by adding, for example, conductive materials such as carbon, metal and conductive polymer to elastic object materials constituting a roller, or by introducing a polarity group to rubber-like polymer constituting elastic object materials.

With respect to cleaning roller 210 in cleaning roller mechanism 202, it is preferable that the direction of rotation of the cleaning roller 210 is made to be opposite to that of photoreceptor 121 so that a movement of the peripheral portion of the cleaning roller and a movement of the peripheral portion of the photoreceptor may be in the same direction at the position where the cleaning roller 210 is in contact with the photoreceptor 121. If the direction of rotation of the cleaning roller 210 is the same as that of the photoreceptor 121, when the toner on the photoreceptor 121 is excessive, there is the possibility that toner removed by the cleaning roller 210 is scattered to contaminate a transfer sheet and the apparatus.

Further, it is preferable that the ratio of linear speed (Vr/Vp) of linear speed (Vr) of the leaning roller 210 to that (Vp) of the photoreceptor 121 is 0.5–2. When the ratio of linear speed (Vr/Vp) is smaller than 0.5, cleaning power is lowered, and image smudge tends to be caused. When the ratio of linear speed (Vr/Vp) is greater than 2, on the other hand, cracks are easily caused on the surface of the photoreceptor 121 when foreign substances are caught between the cleaning roller and the photoreceptor.

The bias voltage impressing means 211 connected with the cleaning roller 210 is composed, for example, of a constant-current power supply, and accepts an electric current that is controlled so that bias voltage with polarity opposite to that of toner to be used for visualizing an electrostatic latent image on the photoreceptor 121 may be impressed on the cleaning roller 210, namely, positive bias voltage may be impressed when toner is charged to be, for example, negative. Due to this, toner is attracted electrostatically to the cleaning roller 210 to be removed from the photoreceptor 121.

Owing to the bias voltage impressing means 211 which is composed of a constant-current power supply, potential difference for surface voltage on the photoreceptor 121 is controlled to be fixed constantly, it is possible to prevent surely occurrence of unevenness and cleaning failure caused by voltage level and polarity on the photoreceptor 121, compared with an occasion where a constant-voltage power supply is used.

It is preferable that a value of an electric current that is impressed on the cleaning roller 210 by the bias voltage impressing means 211 is 1–50 $\mu$A in an absolute value, although it varies depending on a thickness of a photosensitive layer of the photoreceptor 121 and on a size of surface electrical resistance of the cleaning roller 210. When the value of an electric current is smaller than 1 $\mu$A, it is difficult to conduct sufficient cleaning, and when the value of an electric current is greater than 50 $\mu$A, electric discharge tends to be caused.

For example, when a thickness of a photosensitive layer of the photoreceptor 121 is 15–30 $\mu$m and surface electrical resistance of the cleaning roller 210 is $10^2$–$10^{10}$ Ωcm, it is preferable that a value of an electric current to be impressed on the cleaning roller 210 is 5–40 $\mu$A in an absolute value.

Operations of the aforementioned cleaning device will be explained.

When bias voltage corresponding to a size of the controlled electric current is impressed by the bias voltage impressing means 211 on the cleaning roller 210 constituting the cleaning device 200, the cleaning roller is charged to be of a polarity (for example, positive polarity) that is opposite to that of residual toner on the photoreceptor 121 which has passed transfer area T, the greater part of residual toner on the photoreceptor are removed electrostatically. Then, residual toner that has passed the cleaning roller 210 is removed mechanically by the cleaning blade 220. Toner attracted electrostatically from the photoreceptor to the surface of the cleaning roller is removed mechanically by a scraper (not shown) that is in contact with the cleaning roller. The scraper is a lamina made of metal or PET, and it is arranged to be in contact with the cleaning roller to make an acute angle with the direction of rotation of the cleaning roller.

The aforementioned cleaning device exhibits high cleaning effect basically, and it surely removes residual toner on the photoreceptor 121 because both electrostatic cleaning by means of cleaning roller mechanism 202 and mechanical cleaning by means of cleaning blade mechanism 201 are conducted.

In the cleaning blade mechanism 201, vibration-damping member 222 touches cleaning blade 220 for the total area in the axial direction of the photoreceptor 121 without controlling basically an elastic deformation of the cleaning blade 220, and therefore, vibration of the cleaning blade 220 is damped by the vibration-damping member 222, and thereby, the vibration of the cleaning blade 220 can be restrained to be small. Moreover, each tab portion 222A exhibits a vibration-damping function independently each other, and thereby, it is possible to prevent surely occurrence of blade bound, blade eversion, blade squeaking or sipping-through of toner, thus, a high cleaning effect can surely be exhibited.

In the invention, it is possible to exhibit high cleaning power stably for a long time without increasing contact load of cleaning blade 220 against photoreceptor 121 as stated above. It is therefore extremely effective even in the case of a latent image carrier represented by an organic photoreceptor wherein it has been impossible to increase a contact load of cleaning blade 220 in the conventional cleaning device, and it has been difficult to exhibit cleaning power stably for a long time.

The structure of an organic photoreceptor used as a latent image carrier in the image forming apparatus of the invention will be explained as follows.

In the present specification, the organic photoreceptor means an electrophotographic photoreceptor wherein a photosensitive layer composed of an organic compound that is given at least one function out of a charge generation function and a charge transport function is formed on the surface of a conductive support, and it includes all of the organic electrophotographic photoreceptors which have been used such as a photoreceptor composed of an organic charge generation substance or an organic charge transport substance which has been used, and a photoreceptor wherein a polymer complex is used for a charge generation function and a charge transport function.

Conductive Support

As a conductive support constituting an organic photoreceptor, either a sheet-shaped one or a cylindrical one may be used, but it is preferable to use a cylindrical one from the viewpoint of a small-sized image forming apparatus.

When the conductive support is a cylindrical one, the support wherein a straightness tolerance is 0.1 mm or less and circumference deflection tolerance is 0.1 mm or less is preferable. Due to this, images having high image quality can surely be formed.

As a conductive support, the support whose specific resistance is $10^3$ Ωcm or less at ordinary temperature is preferable, and to be concrete, a drum made of metal such as, for example, aluminum or nickel, or a plastic drum whose surface is deposited with aluminum, tine oxide or indium oxide, or a paper/plastic drum whose surface is coated with conductive substances can be used.

The conductive support may further be one wherein an alumite film subjected to the processing of sealing is formed on the surface. The alumite processing is usually conducted in an acidic bath containing, for example, chromic acid, sulfuric acid, oxalic acid, phosphoric acid, boric acid or sulfamic acid, and anodizing in sulfuric acid gives most preferable results. In the case of anodizing in sulfuric acid, it is preferable to conduct it under the condition that sulfuric acid density is 100–200 g/liter, aluminum ion density is 1–10 g/liter, liquid temperature is about 20° C. and impressed voltage is about 20 V, to which, however, the invention is not limited. An average thickness of anodic oxidation coating is preferably 20 μm usually, and 10 μm or less is especially preferable.

Intermediate Layer

In the organic photoreceptor used in the invention, it is also possible to provide an intermediate layer equipped with barrier functions for improvement of adhesion property between a conductive support and a photoreceptor or for preventing injection of electric charges from a conductive support.

As a material for the intermediate layer, there are given, for example, polyamide resin, vinyl chloride resin, vinyl sulfide resin and copolymer resin containing two or more of the repeating units in the aforementioned resins. Among these resins, polyamide resin is preferable to be used because it is possible to make the level of an increase of residual voltage caused by repeated use to be lower.

It is preferable that a thickness of the intermediate layer made of the resin mentioned above is, for example, 0.01–0.5 μm.

Further, the intermediate layer is preferably made of hardening metal resin wherein organic metal compounds such as silane coupling agents or titanium coupling agents are hardened by heat.

In this case, a thickness of the intermediate layer is preferably 0.1–2 μm.

Photosensitive Layer

The photosensitive layer constituting the organic photoreceptor may be one having the single layer structure wherein one layer has a charge generation function and a charge transport function in a single layer on the conductive support layer, but is preferable that the photosensitive layer is one having the structure of layer upon layer wherein a charge generation function and a charge transport function of the photosensitive layer are separated respectively to different layers, namely, to a charge generation layer (CGL) and a charge transport layer (CTL).

Due to the structure wherein a charge generation function and a charge transport function are separated respectively to different layers, it is possible to control the level of an increase of residual voltage caused by repeated use to be lower, and to control other electrophotographic characteristics easily in accordance with objects.

In the organic photoreceptor for negative charging, it is preferable that an intermediate layer is formed on a conductive support, and this intermediate layer has the structure that a charge generation layer (CGL) and a charge transport layer (CTL) are laminated in this order on the intermediate layer.

In the organic photoreceptor for positive charging, on the other hand, sequence of the aforementioned layer arrangement is opposite to that of the organic photoreceptor for negative charging.

As an organic photoreceptor used in the invention, an organic photoreceptor for negative charging having a photosensitive layer having the separated function structure is preferably used.

Charge Generation Layer

In the charge generation layer (CGL), there is contained charge generation material (CGM), and binder resin and other additives may also be contained, if necessary.

A thickness of the charge generation layer (CGL) is preferably 0.01–2 μm.

As a charge generation material (CGM), it is possible to use one which has been used so far, and for example, phthalocyanine pigment, azo pigment, perylene pigment and azulenium pigment can be used. Among them, it is preferable, because it is possible to make an increase of residual voltage caused by repeated use to be smallest, to use one having a three-dimensional potential structure which can take a coagulation structure which is stable among a plurality of molecules, concretely, phthalocyanine pigment having specific crystal structure and perylene pigment.

For example, in titanylphthalocyanine whose Bragg angle 2θ for Cu—Kα has the maximum peak at 27.2° and in benzimidazole perylene wherein 2θ has the maximum peak at 12.4, there hardly exist deterioration caused by repeated use, and an extent of increase in residual voltage can surely be made small.

As a binder resin used as a dispersion medium of a charge generation material (CGM) for a charge generation layer (CGL), resin that is known commonly can be used, and it is preferable to use, for example, formal resin, butyral resin, silicone resin, silicone butyral resin and phenoxy resin. By using these resins, it is possible to control an increase of residual voltage caused by repeated use to be small.

With respect to a ratio of a charge generation material (CGM) to binder resin, a ratio of 20–600 parts by weight to 100 parts by weight of binder resin is preferable.

Charge Transport Layer

In charge transport layer (CTL), there are contained charge transport material (CTM) and binder resin in which the charge transport material (CTM) is dispersed for casting, and if necessary, additives such as antioxidant may also be contained.

A thickness of the charge transport layer (CTL) is preferably 10–14 μm.

As a charge transport material (CTM), it is possible to use one which has been used so far, and for example, triphenylamine derivative, hydrazone compound, styryl compound, benzidine compound and butadiene compound may be used. These charge transport materials (CTM) are usually dissolved in appropriate binder resin for layer formation. Among these materials, a material having high mobility and characteristics that ionization potential difference from charge generation material (CGM) to be combined is 0.5 (eV) or less is preferable because an increase of residual voltage caused by repeated use can be made small, and more preferable is one having 0.25 (eV) or less.

Ionization potential of charge generation material (CGM) and of charge transport material (CTM) can be measured by, for example, surface analysis equipment AC-1 (made by Riken Keiki Co.).

As binder resins used as dispersing agents for charge transport material (CTM), there are given, for example, Polystyrene resin, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, and copolymer resin containing two or more of the repeating units in the aforementioned resins. Further, besides these insulating resin, high molecular organic semiconductor such as poly-N-vinylcarbazole may also be used.

Among the aforementioned resins, polycarbonate resin is preferable to be used from the viewpoint of improving dispersibility and electrophotographic characteristics of a charge transport material (CTM). Further, in the case of a photoreceptor wherein a charge transport material (CTM) comes to the surface layer, it is preferable to use polycarbonate resin excellent in terms of abrasion resistance that is represented by polycarbonate resin having an average viscometric molecular weight of 40,000–200,000.

With respect to a ratio of a charge transport material (CGM) to binder resin, a ratio of 10–200 parts by weight to 100 parts by weight of binder resin is preferable.

Protective Layer

As a protective layer for a photosensitive layer in an organic photoreceptor, various types of resin layers can be provided, and in particular, it is possible to make an organic photoreceptor to have great mechanical strength by providing a resin layer of a cross linkage type.

In the foregoing, a solvent or a dispersion medium used for forming an intermediate layer, a photosensitive layer and a protective layer is not restricted in particular, and what is used preferably includes, for example, n-butylamine, diethylamine, ethylenediamine, isopropanolamine, triethanolamine, triethylenediamine, N,N-dimethylformamido, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve. Among the foregoing, dichloro methane, 1,2-dichloro ethane and methyl ethyl ketone are used preferably. Further, these solvents or dispersion media may also be used either independently or as mixed solvents of two or more types.

As a coating method for manufacturing an organic electrophotographic photoreceptor, there are used coating methods for immersion coating, spray coating and coating of a circular amount control type, however, it is preferable to use the coating method for spray coating or for coating of a circular amount control type (represented by a circular slide hopper type) so that a membrane of a lower layer may not be dissolved to the utmost by the coating operation for the upper layer in the photosensitive layer and uniform coating may be attained. Further, for the protective layer, it is preferable to use a coating method of a circular amount control type which is described in detail in, for example, TOKKAISHO No. 58-189061.

In the invention, occurrence of cleaning failure caused by slipping-through of toner can be prevented more surely by using specific toner.

Toner to be used in the invention will be explained as follows.

It is preferable that toner used in the invention is (1) one composed of toner particles wherein a percentage of toner particles whose shape factor is within a range of 1.2–1.6 is 65 number % or more, and a variation coefficient of the shape factor is 16% or less, (2) one composed of toner particles wherein a variation coefficient of the shape factor is 16% or less, and the number variation coefficient in number particle size distribution is 27% or less, (3) one composed of toner particles wherein a percentage of toner particles having no corners is 50 number % or more or one wherein the aforementioned ones are combined.

By using toner wherein the structure (shape, particle diameter and others) of toner itself is specific, namely, by using toner made by making a shape of a toner particle to be specific, making a shape of a toner particle to be uniform, or further combining these, it is possible to control vibration of cleaning blade 220 in cleaning device 200 to be small, and to exhibit high cleaning effect more surely.

In the invention, a shape factor of toner is expressed by the following expression, and it shows a degree of sphericity of a toner particle.

$$\text{Shape factor}=((\text{maximum diameter}/2)^2\times\pi)/\text{Projective area}$$

The maximum diameter in this case means a width of the toner particle whose projected image makes a distance between two parallel lines which pinch the projected image of the toner particle to be the maximum. Further, the projected area is an area of the image of a toner particle projected on a plane.

In the invention, this shape factor was obtained by the method wherein a photograph of a toner particle enlarged by 2000 times was made by the use of an electron microscope of a scanning type, and based on this photograph, measurement was taken by analyzing the photographic image by the use of "SCANNING IMAGE ANALYZER" (made by Nihon Denshi Co.). In this case, 100 toner particles were used to measure the shape factor in the invention by using the aforementioned calculation expression.

In toner used in the invention, it is preferable to make a percentage of toner particles whose shape factor is within a range of 1.2–1.6 to be 65 number % or more, and more preferable is 70 number % or more.

When the percentage of the toner particle whose shape factor is within a range of 1.2–1.6 is 65 number % or more, frictional electrification of developing agent conveyance member (carrier) becomes more uniform, and accumulation of toner charged excessively can be lowered, and conveyance of toner by the developing agent conveyance member becomes more smooth, thus, occurrence of a problem of development ghost becomes rare. In addition, toner particles become hard to be crushed, and contamination of a charge providing member (charging unit) is reduced, a property of charging toner can be stabilized.

A method to control the shape factor is not restricted in particular. For example, there are available a method to spray toner particles in a hot air current, or a method to give mechanical energy caused by impact force repeatedly to toner particles in a vapor phase, or a method to prepare toner whose shape factor is 1.2–1.6 in a method to add toner in a solvent which dissolves no toner and to give circling current, and to add this toner to ordinary toner and adjust it by keeping the range of the invention. There is further a method to control an overall shape at the step to adjust the so-called polymerization method toner, and to add toner whose shape factor has been adjusted to 1.2–1.6 to ordinary toner, for adjustment.

A variation coefficient of a shape factor of toner used preferably in the invention is calculated from the following expression.

$$\text{Variation coefficient}=(S/K)\times 100(\%)$$

(In the expression, S represents a standard deviation of the shape factor of 200 toner particles, and K represents a mean value of the shape factors.)

In the case of toner used in the invention, it is preferable that a variation coefficient of the shape factor is made to be 16% or less, and more preferable is 14% or less. Owing to the variation coefficient of the shape factor which is 16% or less, air gaps in the transferred toner layer are reduced and fixing property is improved accordingly, thus, offsetting becomes hard to be caused. In addition, distribution of an amount of charging becomes sharp, and image quality is improved.

To control the shape factor and the variation coefficient of the toner to be uniform to the utmost without dispersion between lots, an appropriate process ending time may also be determined while monitoring characteristics toner particles (colored particles) which are being formed, in the process for polymerization of resin particles (polymer particles), fusion and shape control.

Monitoring means controlling the process conditions based on the results of measurement by measuring instruments incorporated on an inline basis. Namely, in the case of polymerization toner formed through association or fusion of resin toner in aqueous medium, by incorporating measurement of shapes in inline, shapes and particle diameters are measured while sampling is conducted successively in the process of fusion, and reaction is stopped at a point of time when a desired shape is attained.

In regard to a monitoring method, it is not limited in particular, and a flow type particle image analysis equipment FPIA-2000 (made by SYSMEX Corporation) can be used. This equipment is ideal because it is possible to monitor the shape by conducting image processing on a real time basis while making a sample solution to pass through. Namely, monitoring is conducted constantly from the reaction field by using a pump, while measuring a shape, and then, the reaction is stopped when the desired shape is observed.

The number particle size distribution and a number variation coefficient of toner in the invention are measured by Coulter counter TA-II or Coulter multisizer (made by Coulter Co.). In the invention, Coulter multisizer was used by connecting to Interface (made by Nikkaki Co.) and a personal computer. As an aperture used in the Coulter multisizer, a 100 $\mu$m aperture was used, and particle size distribution and an average particle size were calculated by measuring a volume and number of toner of 2 $\mu$m or larger. Number particle size distribution is one showing the relative frequency of toner particles for particle diameter, and number average particle diameter is one showing a median diameter in the number particle size distribution. The number variation coefficient in the number particle size distribution of toner is calculated from the following expression;

$$\text{Number variation coefficient}=(S/Dn)\times 100(\%)$$

(wherein, S represents a standard deviation in the number particle size distribution, and Dn represents the number average particle diameter ($\mu$m).)

In the case of toner used in the invention, it is preferable that the number variation coefficient is made to be 27% or less, and more preferable is 25% or less. Owing to the number variation coefficient that is 27% or less, air gaps in the transferred toner layer are reduced and fixing property is improved accordingly, thus, offsetting becomes hard to be caused. In addition, distribution of an amount of charging becomes sharp and transfer efficiency becomes high, thus, image quality is improved.

There is no restriction, in particular, for the method to control the number variation coefficient. For example, a method of classification in a liquid is effective for making the number variation coefficient to be small, although a method to classify toner particles with wind power can be used. As a method for classification in a liquid, there is available a method to manufacture by separating and collecting toner particles in accordance with a difference of a sedimentation velocity caused by a difference of toner particle diameter, by using a centrifugal separator and by controlling a speed of rotation.

When manufacturing toner through a suspension polymerization method in particular, classification operations are indispensable for making the number variation coefficient in the number particle size distribution to be 27% or less. In the suspension polymerization method, it is necessary to disperse polymerizable monomers in an aqueous medium to be a droplet of oil whose size is a desired one as toner, before polymerization. Namely, mechanical shearing is applied on a large-sized droplet of oil of polymerizable monomer repeatedly by a homo-mixer or a homogenizer to make the droplet of oil small approximately to the size of a toner particle. However, in the method of the mechanical shearing, the number particle size distribution of droplets of oil thus obtained is broad, and the particle size distribution of toner made by polymerizing the foregoing is also broad accordingly. Therefore, classification operations are indispensable.

In the case of toner used in the invention, a toner particle having no corner means a toner particle that substantially has no protrusion where electric charges are concentrated, or no protrusion that is easily worn away by stress. Namely, under the condition that L represents a major axis of toner particle T, when circle C having radius (L/10) is made to roll along a peripheral line of toner particle T while touching at one point on the inside of the peripheral line, if circle C does not protrude out of toner T substantially, as shown in FIG. 15(*a*), the toner particle T is called "toner particle having no corner". "An occasion of no protruding substantially" means the case wherein the number of protrusions where the circle protrudes out is not more than one. "A major axis of toner particle" means a width of the toner particle whose projected image makes a distance between two parallel lines which pinch the projected image of the toner particle to be the maximum. Further, the projected area is an area of the image of a toner particle projected on a plane. Incidentally, each of FIG. 15(*b*) and FIG. 15(*c*) shows a projected image of a toner particle having corners.

Measurement of toner having no corners was conducted as follows. First, a photograph of a toner particle enlarged by 2000 times was made by the use of an electron microscope of a scanning type, and it is further enlarged to obtain a photographic image enlarged by 15000 times. Then, this photographic image was measured in terms of existence of the corners. This measurement was conducted for ten toner particles.

In the case of toner used in the invention, it is preferable that a rate of toner particles having no corners is 50 number % or more, and more preferable is 70 number % or more. When the rate of toner particles having no corners is 50 number % or more, occurrence of fine particles becomes hard to be caused by stress with a developing agent conveyance member, and it is possible to prevent the existence of toner having excessively large adhesiveness to the surface of the developing agent conveyance member, and to repress contamination for the developing agent conveyance member. Further, toner particles which are easily worn away or destroyed and toner particles each having a portion where electric charges are concentrated decrease, and thus, distribution of an amount of charging becomes sharp, electrification property is stabilized, and images having high image quality are formed stably for a long time.

There is no restriction, in particular, for the method to obtain toner having no corners. For example, as a method to control the shape factor, there is available, as stated above, a method to spray toner particles in a hot air current, or a method to give mechanical energy caused by impact force repeatedly to toner particles in a vapor phase, or a method to add toner in a solvent which dissolves no toner and to give circling current.

In the case of polymerization toner formed through association or fusion of resin toner, many irregularities are present on the surface of the fused particle and the surface is not smooth when the fusion is stopped, but it is possible to obtain toner particles having no corners, by making conditions such as temperature, the speed of rotation of impellers and time for stirring to be appropriate ones. Though these conditions are varied depending on physical characteristics of resin particles, the surface becomes smooth and toner particles having no corners can be formed, when the temperature higher than a glass transition point of resin particles and higher speed of rotation, for example, are selected.

In the case of toner used in the invention, it is preferable that the toner is one whose average number particle diameter is 3–8 μm. When forming toner particles through a polymerization method, a particle diameter can be controlled by density of coagulant, weight of added organic solvent, or polymerization time, further by composition of a polymer itself.

When the average number particle diameter is 3–8 μm, it is possible to decrease existence of toner whose adhesiveness to the developing agent conveyance member is excessively great in the fixing process and of toner whose adhesive power is poor, and to obtain excellent developability stably for a long time, thus, transfer efficiency becomes high and image quality of halftone and image quality of fine lines and dots are improved.

In the case of toner used preferably in the invention, when D (μm) represents a particle diameter of a toner particle, it is preferable that the sum total (M) of relative frequency (m1) included in the most frequent rank and relative frequency (m2) of toner particle included in the rank that is second highest rank to the most frequent rank is 70% or more, in the histogram showing the particle size distribution of the number basis wherein the horizontal axis is represented by natural logarithm lnD and this horizontal axis is divided into plural ranks at an interval of 0.23.

When the sum total (M) of relative frequency (m1) and relative frequency (m2) is 70% or more, the extent of dispersion in particle size distribution of toner particle becomes narrow, and thereby, it is possible to restrain surely occurrence of selection development by using the aforementioned toner in the image forming process.

In the invention, the histogram showing particle size distribution of the number basis is a histogram showing particle size distribution of the number basis wherein natural logarithm lnD (D: particle diameter of individual toner particle) is divided at interval of 0.23 into plural ranks (0–0.23:0.23–0.46:0.46–0.69:0.69–0.92:0.92–1.15:1.15–1.38:1.38–1.61:1.61–1.84:1.84–2.07:2.07–2.30:2.30–2.53:2.53–2.76 . . . ), and this histogram is one prepared by particle size distribution program in the computer to which the particle diameter data of the sample measured by Coulter multisizer under the following condition has been transferred through I/O unit.

Measurement Condition (1) Aperture: 100 μm (2) Sample preparing method: An appropriate amount of surfactant (neutral detergent) is added to 50–100 ml of electrolytic solution (ISOTON R-11 (made by Coulter Scientific Japan Co.) to be stirred, and 10–20 mg of measurement sample is added to the foregoing to prepare a mixture solution. The mixture solution was subjected to dispersion processing for one minute by an ultrasonic homogenizer to prepare a sample.

In the methods for controlling the shape factor, a polymerization toner is preferable on the points that the manufacturing method therefor is simple and uniformity on the surface of the polymerization toner is excellent compared with that of crushed toner.

It is preferable that toner used in the invention is one obtained by polymerizing at least a polymerizable monomer in aqueous medium, or one obtained through association of at least resin particle in aqueous medium. A method to manufacture toner will be explained in detail as follows.

Toner used in the invention can be manufactured by, for example, a suspension polymerization method, or a method wherein a monomer is subjected to emulsion polymerization in a solution containing necessary additives to make fine grains of polymer particles, then, an organic solvent and a coagulating agent are added thereto to be associated. It is further possible to manufacture by a method wherein there are mixed a monomer and a dispersed solution of releasing agents and coloring agents both necessary for constituting toner, or a method wherein toner constituent components such as releasing agents and coloring agents are dispersed in a monomer and then they are subjected to emulsion polymerization. In this case, "association" means that a plurality of resin particles and a plurality of coloring agent particles are fused. Further, an aqueous medium mentioned in the invention is one containing at least 50% by weight of water.

In an example of the method for manufacturing toner, various constituent materials such as a coloring agent and further, if necessary, a releasing agent, a charge controlling agent and a polymerization starting agent are added to a solvent of polymerizable monomer, and the various constituent materials are dissolved or dispersed in the solvent of polymerizable monomer by a homogenizer, a sand mill, a sand grinder or an ultrasonic homogenizer. The solvent of polymerizable monomer in which the various constituent materials are dissolved or dispersed is dispersed in an aqueous medium containing dispersion stabilizing agents by the use of a homo-mixer or a homogenizer, to obtain a dispersion solution containing an oil droplet having a desired size as toner. After that, the dispersion solution is put in a reaction vessel wherein a stirring mechanism is represented by a stirring blade stated later, to be heated so that polymerization reaction is advanced. After completion of the reaction, the dispersion stabilizing agents are removed, and the dispersion solution is filtered, washed and dried, to prepare toner.

Further, as a method to manufacture toner, there is given a method wherein resin particles are subjected to association or fusion in aqueous medium to manufacture toner. This method is not limited in particular, and is disclosed in, for example, TOKKAIHEI Nos. 5-265252, 6-329947 and 9-15904. Namely, it is possible to manufacture toner in a method wherein a plurality of resin particles and dispersion particles of constituent materials such as coloring agents are subjected to association, and in particular, it is possible to manufacture toner by adding coagulant having critical coagulation density or higher for salting-out after dispersing in water by using an emulsifier, by heating for fusion at a glass transition point of the formed polymer itself so that fused particles may be formed while growing gradually in terms of a particle diameter, by stopping growth of the particle diameter by adding a large amount of water when the particle diameter shows the aimed value, by controlling a shape by smoothing the particle surface while heating and stirring further, and by heating and drying the particles under the flowing condition while they are in the state of containing water (salting-out/fusion). Incidentally, a solvent that dissolves infinitely in water may also be added simultaneously with coagulant.

Those used as polymerizable monomers constituting resins include styrene or styrene derivatives such as, o-methylstyrene, m-methylstyrene, o-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene;

methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, and dimethyl aminoethyl methacrylate;

acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like;

olefins such as ethylene, propylene, isobutylene, and the like, halogenated vinyls such as vinyl chloride, vinylidene chloride, vinyl bromide, vinyl fluoride, vinylidene fluoride, and the like, and vinyl esters such as vinyl propionate, vinyl acetate, vinyl benzoate, and the like;

vinyl ethers such as vinyl methyl ether, vinyl ethyl ether, and the like;

vinyl ketones such as vinyl methyl ketone, vinyl ethyl ketone, vinyl hexyl ketone, and the like;

N-vinyl compounds such as N-vinylcarbazole, N-vinylindole, N-vinylpyrrolidone, and the like;

vinyl compounds such as vinylnaphthalene, vinylpyridine, and the like;

acrylic acid or methacrylic acid derivatives such as acrylonitrile, methacrylonitrile, acrylamide, and the like.

These vinyl monomers can be used either independently or in combination.

Further, it is more preferable that those having ionic dissociation groups as polymerizable monomers constituting resins are used in combination. Examples thereof are those each having a substituent such as carboxyl group, sulfonic acid group and phosphoric acid group as a constituting group of a monomer, and there are concretely given acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acidphosphoxyethyl methacrylate, 3-chloro-2-acidphosphoxypropyl methacrylate.

It is further possible to make resins of a cross linkage structure by using polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

These polymerizable monomers can be polymerized by using radial polymerization starting agents. In this case, oil-soluble polymeriztion starting agents can be used for the suspendion polymerization method. As this oil-soluble polymeriztion starting agent, there are given azo or diazo polymerization starting agents such as 2,2'-azobis-(2,4-dimethylvaleronitrile), 2,2'-azobisisobutyronitrile, 1,1'-azobis(cyclohexane-1-carbonitrile, 2,2'-azobis-4-methoxy-2,4-dimethylvaleronitrile, azobisisobutyronitrile; and peroxide polymerization starting agent such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxydichlorohexyl)propane, tris-(t-butylperoxy) triazine, or high polymer starting agent having peroxide on the side chain.

Further, when using an emulsion polymerization method, a water-soluble radical polymerization starting agent can be used. As a water-soluble polymerization starting agent, there are given persulfate such as potassium persulfate and ammonium persulfate, azobisamino dipropane acetate, azobiscyano valeric acid and its salt and hydrogen peroxide.

As a dispersion stabilizing agent, there are given tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina.

Further, as a dispersion stabilizing agent, it is possible to use one used generally as a surfactant such as polyvinyl alcohol, gelatin, methylcellulose, sodium dodecylbenzenesulfonate, ethylene oxide addition products, sodium higher alcohol sulfonate.

As excellent resin in the invention, resin whose glass transition point is 20–90° C. is preferable, and resin whose softening point is 80–220° C. is preferable.

The glass transition point is one to be measured by differential thermal analysis method, while the softening point can be measured by Capillary Rheometer Shimazu Flowmeter. Further, as these resins, the resin whose molecular weight measured by a gel permeation chromatography is 1000–100000 in terms of number average molecular weight (Mn), and is 2000–1000000 in terms of weight average molecular weight (Mw) is preferable. Further, as molecular weight distribution, the one having Mw/Mn of 1.5–100 is preferable and the one having Mw/Mn of 1.8–70 is especially preferable.

Though coagulants used in association of the resin particles in aqueous medium are not limited in particular, those selected from metal salt are used preferably. To be concrete, there are given a salt of an alkali metal such as, for example, sodium, potassium and lithium as a monovalent metal, a metal salt of alkaline earths such as, for example, calcium and magnesium, as a divalent metal, a salt of divalent metal such as manganese and copper, and a salt of trivalent metal such as iron and aluminum. As a concrete salt, there are given sodium chloride, potassium chloride, lithium chloride, calcium chloride, zinc chloride, copper sulfate, magnesium sulfate, and manganese sulfate. These may also be used in combination.

It is preferable that the coagulants stated above are added to exceed the critical coagulation density. This critical coagulation density is an index relating to stability of water dispersion, and it shows density at which the coagulation is generated after coagulants are added. This critical coagulation density varies greatly depending on the emulsified components and dispersing agents themselves. For example, it is described in "High Polymer Chemistry 17,601 (1960) compiled by Institute of High Polymer" written by Seizo Okamura and others, and detailed critical coagulation density can be obtained. Further, in another method, a desired salt is added to a particle dispersed solution targeted by changing density, then, ζ voltage of its dispersed solution is measured, and salt density at which the measured value changes can also be obtained as critical coagulation density.

With regard to an amount of added coagulants in the invention, the amount corresponding to the critical coagulation density or higher is acceptable, but the preferable amount is one corresponding to the density which is 1.2 times the critical coagulation density, and the more preferable is one corresponding to the density which is 1.5 times the critical coagulation density.

"A solvent that dissolves infinitely in water" to be used together with coagulants means a solvent that dissolves infinitely in water, and for this solvent, there is selected one in which the resin formed is not dissolved in the invention. In concrete terms, there may be given alcohols such as methanol, ethanol, propanol, isopropanol, t-butanol, methoxy ethanol and butoxy ethanol, nitryl such as acetonitrile and ether such as dioxane. In particular, ethanol, propanol and isopropanol are preferable.

It is preferable that an amount of the solvent dissolving infinitely is 1–100% by volume of a polymer containing dispersed solution to which coagulants have been added.

Incidentally, for uniformizing a shape, colored particles are prepared, then, after filtration, slurry wherein water of not less than 10% by weight of particles is contained is preferably subjected to fluid drying, and in this case, the one having a polarity group in a polymer is especially preferable. The reason for that is as follows;

water existing exhibits an effect to swell to some extent for the polymer having therein a polarity group, and thereby, a shape is easily uniformized in particular.

Toner used in the invention contains at least resins and coloring agents, and in case of need, it may also contain releasing agents representing fixing property improving agents or charging controlling agents. Further, it may also be one wherein external additives composed of inorganic fine particles and organic fine particles are added to toner particles containing therein the aforementioned resins and coloring agents as main components.

As coloring agents used for toner that is used in the invention, carbon black, magnetic substances, dyes and pigments can be used voluntarily, and as carbon black, there are used channel black, furnace black, acetylene black, thermal black and lamp black. As magnetic substances, there may be used ferromagnetic metal such as nickel and cobalt, alloys containing these metals, compounds of ferromagnetic metal such as ferrite and magnetite, alloys containing no ferromagnetic metal but showing ferromagnetism after being subjected to heat treatment, for example, alloys of the kind called Heusler's alloy such as manganese-copper-aluminum and manganese-copper-tin, and chromium dioxide.

As dyes, it is possible to use C. I. solvent reds 1, 49, 52, 58, 63, 111 and 122, C. I. solvent yellows 19, 44, 77, 79, 81, 82, 93, 98, 103, 104, 112 and 162, and C. I. solvent blues 25, 36, 60, 70, 93 and 95, and further, mixtures of the foregoing may also be used. As pigments, it is possible to use C. I. pigment reds 5, 48:1, 53:1, 57:1, 122, 139, 144, 149, 166, 177, 178 and 222, C. I. pigment oranges 31 and 43, C. I. pigment yellows 14, 17, 93, 94 and 138, C. I. pigment green 7 and C. I. pigment blues 15:3 and 60, and further, mixtures of the foregoing may also be used. Number average primary particle diameters are various depending on types, and what is preferable is about 10–200 nm.

As a method of adding coloring agents, it is possible to use a method wherein coloring agents are added to color a polymer in the step to coagulate polymer particles prepared by an emulsion polymerization method by adding coagulants, and a method wherein coloring agents are added in the step to polymerize monomers for polymerization and preparation of colored particles. Incidentally, when adding coloring agents in the step to prepare polymers, it is preferable to use the coloring agents after treating the surface with coupling agents so that radical polymerization may not be inhibited.

Further, low molecular weight polypropylene (number average molecular weight=1500–9000) serving as fixing property improving agents and low molecular weight polyethylene may be added.

Further, various charging controlling agents which are known and are capable of being dispersed in water can be used. To be concrete, there are given nigrosine dyes, metal salt of naphthenic acid or of higher fatty acid, alkoxyl amine, a quaternary ammonium salt compound, azo metal comples and metal salt salicylate or its metal complex.

Incidentally, with respect to particles of charging controlling agents and fixing property improving agents, it is preferable that the number average primary particle diameter under the dispersed state is made to be about 10–500 nm.

In the case of toner by a suspension polymerization method wherein toner is obtained through suspension of polymerizable monomer in which toner constituent components such as coloring agents are dispersed or dissolved in the water medium and through polymerization, it is possible to control a shape of toner by controlling a flow of medium in a reaction vessel in which polymerization reaction is carried out. Namely, when forming a large number of toner particles having a shape with a shape factor of 1.2, a flow of medium in the reaction vessel is made to be a turbulent flow, and at the point of time when oil droplets existing in water medium under the state of suspension change gradually into macromolecule after progress of polymerization and they turn out to be soft particles, particles are made to collide to accelerate association, and thus, particles having irregular shapes are obtained. When forming spherical toner particles whose shape factor is smaller than 1.2, a flow of the medium in the reaction vessel is made to be a laminar flow, and collision of particles is avoided, thus, spherical particles are obtained. In this method, distribution of toner shapes can be controlled to be within a range of the invention. A reaction apparatus used preferably will be explained as follows.

Figure 5:
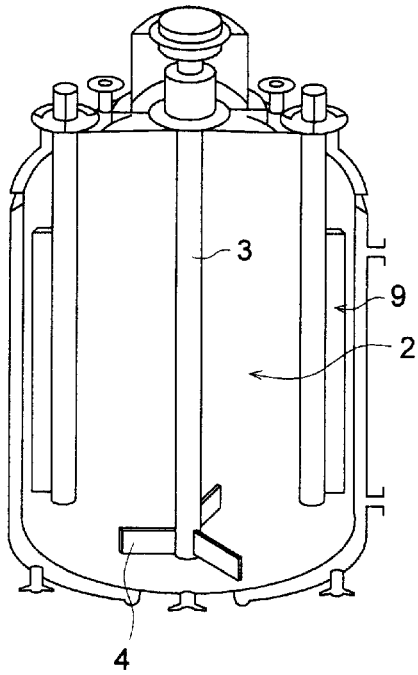
FIG. 5 is an illustration showing a reactor having therein an impeller of a single step structure.

FIG. 5 is an illustration showing a reaction apparatus (stirring apparatus) which is used generally and has the structure of stirring blade of a one step type, and the numeral 2 represents a stirring tank, 3 represents a rotary shaft, 4 represents a stirring blade and 9 represents a turbulent flow forming member.

In the suspension polymerization method, it is possible to form a turbulent flow by using a specific stirring blade, and to control a shape easily. Though the reason for this is not clear, when the structure of stirring blade 4 is of one step as shown in FIG. 5, a flow of medium formed in stirring tank 2 becomes only a flow moving along the wall surface from the lower portion to the upper portion of the stirring tank 2. In the past, therefore, turbulent flow forming member 9 on the wall face of the stirring tank 2 has been arranged in general to form a turbulent flow and to increase efficiency of stirring. In such structure of apparatus, however, existence of the turbulent flow makes a flow of the medium to stagnate, resulting in less shear for the particles which makes it impossible to control shapes.

A reaction apparatus equipped with a stirring blade that can be used preferably in a suspension polymerization method will be explained, referring to the drawings.

Figure 6:
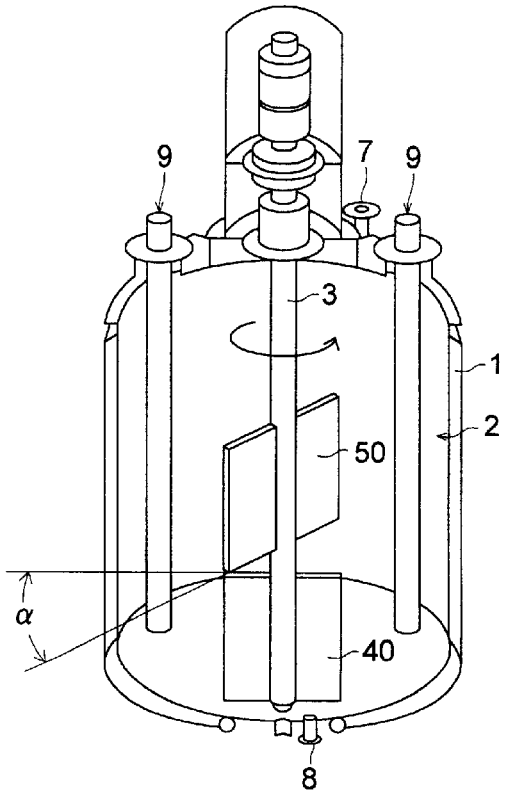
FIG. 6 is a perspective view showing an example of a reactor equipped with an impeller which can be used favorably.
Figure 7:
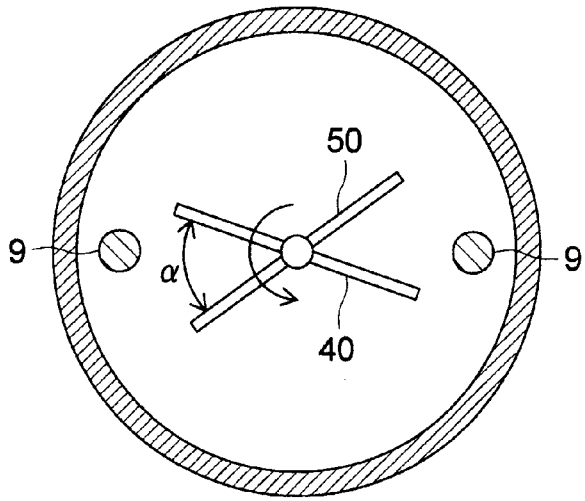
FIG. 7 is a sectional view of the reactor shown in FIG. 5.

FIG. 6 and FIG. 7 are respectively a perspective view and a sectional view each showing an example of the reaction apparatus of the aforementioned type. In the reaction apparatus shown in FIGS. 6 and 7 rotary shaft 3 is arranged vertically at the central portion of cylindrical stirring tank 2 of a vertical type equipped with jacket for heat exchanging, and lower stirring blade 40 arranged to be near the bottom surface of the stirring tank 2 and stirring blade 50 arranged to be higher than the stirring blade 40 are provided on the rotary shaft 3. The upper stirring blade 50 is arranged to be ahead of the stirring blade 40 positioned at a lower step by crossed axes angle $\alpha$ in the direction of rotation. In the course of manufacturing toner of the invention, crossed axes angle $\alpha$ which is less than 90° is preferable. Though the lower limit of the crossed axes angle α is not limited in particular, 5° or more is preferable, and more preferable is 10° or more. Incidentally, when providing three-stepped stirring blades, a crossed axes angle between adjoining stirring blades which is less than 90° is preferable.

By employing the structure of this kind, the medium is stirred first by the stirring blade 50 arranged on the upper step, and a flow toward the lower side is formed. Then, the flow formed by the upper stirring blade 50 is accelerated downward by the stirring blade 40 arranged on the lower step, and another flow toward the lower portion is formed by the stirring blade 50 itself, thus, it is assumed that the total flow is accelerated to be advanced. As a result, it is assumed that a flow area having great shear stress formed as a turbulent flow is formed, and thereby, shapes of toner particles obtained can be controlled.

Incidentally, in FIG. 6 and FIG. 7, an arrow shows the direction of rotation, the numeral 7 represents an upper material inlet, 8 represents a lower material inlet and 9 represents a turbulent flow forming member for making stirring to be effective.

Though shapes of stirring blades are not restricted in particular, in this case, there may be used a square and flat blade, a blade having a cut-out on a part of the blade and a blade having one or more holes, namely, the so-called slits on the central portion of the blade. These concrete examples are described in FIGS. 14(*a*)–(*d*). Stirring blade 5*a* shown in FIG. 14(*a*) is one having no inner hole section, stirring blade 5*b* shown in FIG. 14(*b*) is one having big inner hole section 6*b* at the central portion, stirring blade 5*c* shown in FIG. 14(*c*) is one having horizontal inner hole sections 6*c* (slits) and stirring blade 5*d* shown in FIG. 14(*d*) is one having vertical inner hole sections 6*d* (slits). In the case of providing stirring blades in a three-step structure, an inner hole section formed on the upper stirring blade and that formed on the lower stirring blade may be either different each other or the same.

Each of FIG. 8–FIG. 12 is a perspective view showing a concrete example of a reaction apparatus equipped with a stirring blade which can be used preferably, and in FIG. 8–FIG. 12, the numeral 1 is a jacket for heat exchanging, 2 is a reaction tank, 3 is a rotary shaft, 7 is an upper material inlet, 8 is an lower material inlet and 9 is a turbulent flow forming member.

Figure 8:
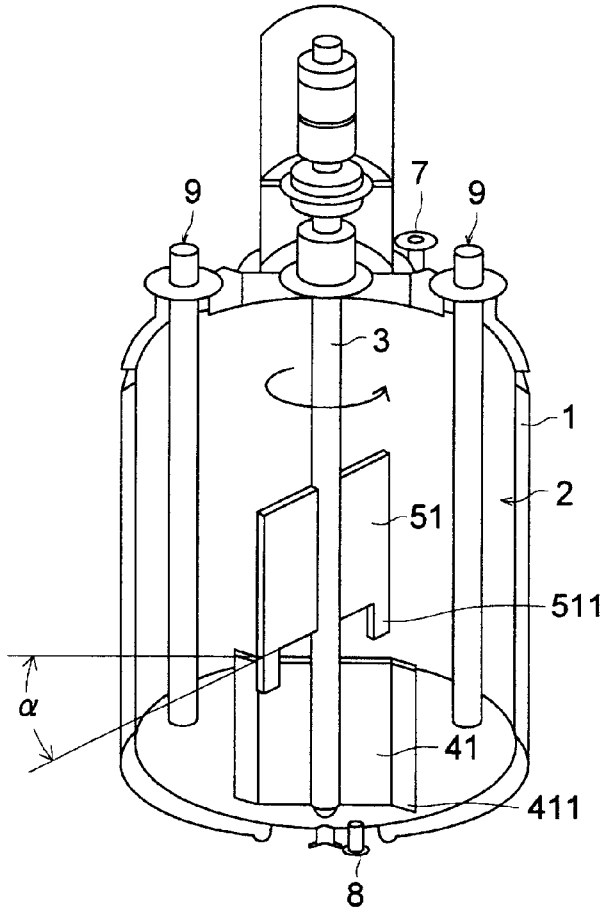
FIG. 8 is a perspective view showing a concrete example of a reactor equipped with an impeller which can be used favorably.

In the reaction apparatus shown in FIG. 8, bent portion 411 is formed on stirring blade 41 and fin (protrusion) 511 is formed on stirring blade 51.

Incidentally, when a bent portion is formed on the stirring blade, it is preferable that an angle of bending is 5–45°.

Figure 9:
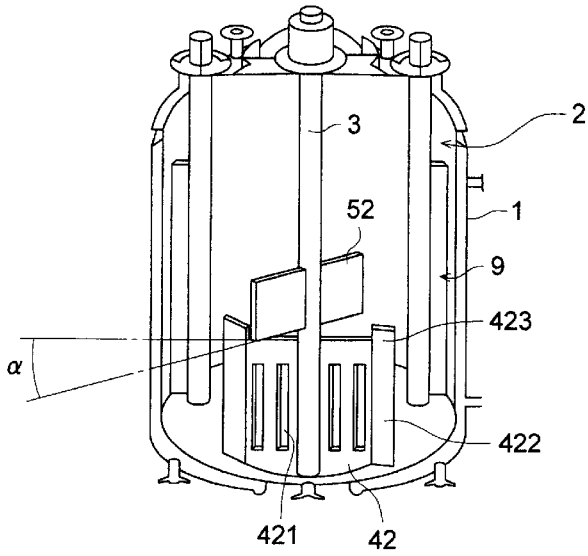
FIG. 9 is a perspective view showing a concrete example of a reactor equipped with an impeller which can be used favorably.

On stirring blade 42 constituting the reaction apparatus shown in FIG. 9, there are formed slit 421, bent portion 422 and fin 423.

Stirring blade 52 constituting the aforementioned reaction apparatus has the same form as that of stirring blade 50 constituting the reaction apparatus shown in FIG. 5.

Figure 10:
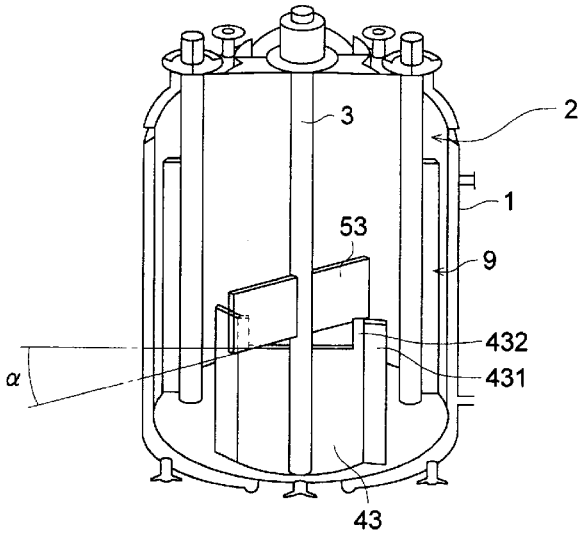
FIG. 10 is a perspective view showing a concrete example of a reactor equipped with an impeller which can be used favorably.

On stirring blade 43 constituting the reaction apparatus shown in FIG. 10, there are formed bent portion 431 and fin 432.

Incidentally, stirring blade 53 constituting the aforementioned reaction apparatus has the same form as that of stirring blade 50 constituting the reaction apparatus shown in FIG. 6.

Figure 11:
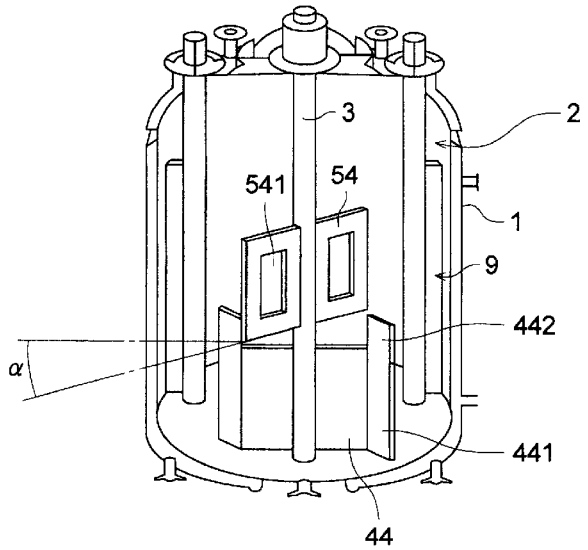
FIG. 11 is a perspective view showing a concrete example of a reactor equipped with an impeller which can be used favorably.

On stirring blade 44 constituting the reaction apparatus shown in FIG. 11, there are formed bent portion 441 and fin 442.

On stirring blade 54 constituting the aforementioned reaction apparatus, there is formed inner hole portion 541 at the center.

Figure 12:
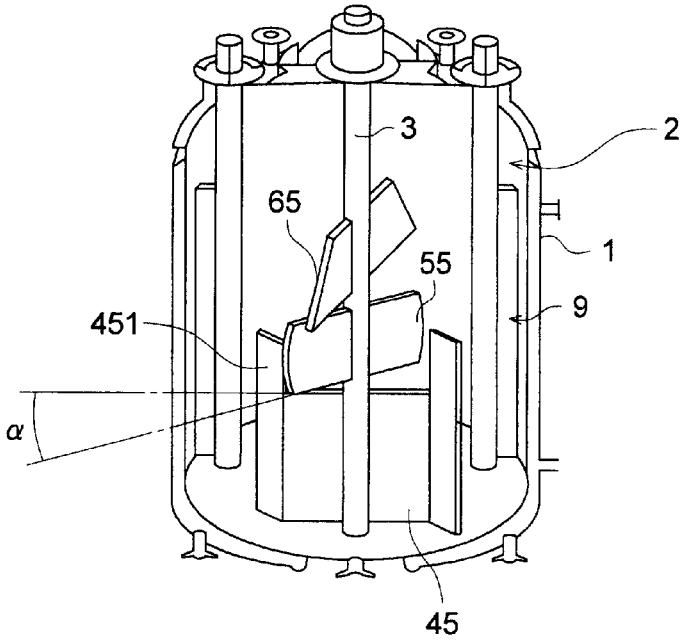
FIG. 12 is a perspective view showing a concrete example of a reactor equipped with an impeller which can be used favorably.

On the reaction apparatus shown in FIG. 12, there is provided a stirring blade of a three-step structure composed of stirring blade 45 (lower step), stirring blade 55 (intermediate step) and stirring blade 65 (upper step), and bent portion 451 is formed on the stirring blade 45.

The stirring blade having the structure including the bent portion and the protrusion (fin) projecting upward or downward mentioned above is one for generating a turbulent flow effectively.

Incidentally, a clearance between the stirring blade on the upper step and that on the lower step in the aforesaid structure is not restricted in particular, but it is preferable that at least a clearance is present between blades. The reason for this is not clear, but it is considered that the stirring efficiency is improved because a flow of medium is formed through the clearance. However, the clearance is the same in terms of dimension as a width that is 0.5%–50%, preferably 1%–30% of a height of a liquid level in the state of standing.

Further, the sum total of heights for all blades is 50%–100%, preferably 60%–95% of a height of a liquid level in the state of standing, though a size of the stirring blade is not limited in particular.

Figure 13:
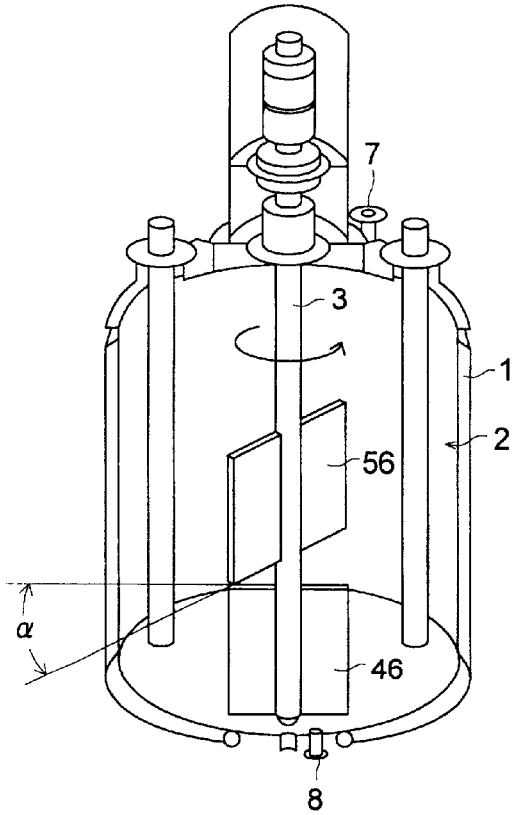
FIG. 13 is a perspective view showing an example of a reactor that is used when forming a laminar flow.

FIG. 13 shows an example of a reaction apparatus that is used when forming a laminar flow in a suspension polymerization method. This reaction apparatus is characterized in that a turbulent flow forming member (an obstacle such as an interrupting plate) is not provided.

Stirring blade 46 and stirring blade 56 constituting the reaction apparatus shown in FIG. 13 respectively have the same form and crossed axes angle α as those of stirring blade 40 and stirring blade 50 constituting the reaction apparatus shown in FIG. 6. Further, in FIG. 13, the numeral 1 is a jacket for heat exchanging, 2 is a reaction tank, 3 is a rotary shaft, 7 is an upper material inlet and 8 is an lower material inlet.

A reaction apparatus used for forming a laminar flow is not limited to one shown in FIG. 13.

Further, a form of a stirring blade constituting the reaction apparatus mentioned above is not restricted in particular provided that a turbulent flow is not formed, but the one formed by a continuous surface such as a square and flat one is preferable, and it may have a curved surface.

On the other hand, in the case of toner by polymerization method wherein resin particles are subjected to association or fusion in water medium, it is possible to change optionally a form distribution and forms for the whole toner, by controlling a flow and temperature distribution in the reaction vessel at the step of fusion, or further by controlling the heating temperature, the number of revolutions for stirring and a period of time in the shape controlling step after fusion.

Namely, in the case of toner by polymerization method wherein resin particles are subjected to association or fusion, it is possible to form toner having a targeted shape factor and a uniform shape distribution, by using a stirring blade and a stirring tank which can make a flow in the reaction apparatus to be a laminar flow and can uniformize inner temperature distribution, and by controlling a fusion process and a temperature, the number of revolutions and a period of time in the fusion process. The assumed reason for the foregoing is as follows; when the field where a laminar flow has been formed is magnetized, intensive stress is not applied on particles (associated or coagulated particles) on which coagulation and fusion have been advanced, and temperature distribution in the stirring tank is uniform in the laminar flow wherein a flow has been accelerated, and thereby, the shape distribution of fused particles becomes to be uniform. Further, the fused particles are changed into spheres gradually by heating and stirring in the form controlling step thereafter, thus, a form of a toner particle can be controlled optionally.

As a stirring blade and a stirring tank used in the course of manufacturing toner by polymerization method wherein resin particles are subjected to association or fusion, it is possible to use ones which are the same as those in the case of forming a laminar flow in the above-mentioned suspension polymerization method, and for example, the one shown in FIG. 13 can be used. It is characteristic that an obstacle such as an interrupting plate causing a turbulent flow is not provided in the stirring tank. With regard to the structure of the stirring blade, it is preferable to employ a multi-step structure wherein a stirring blade on the upper step is arranged to be ahead of a stirring blade on the lower step by crossed axes angle $\alpha$ in the direction of rotation, which is the same as the stirring blade used in the aforesaid suspension polymerization method.

With regard to a form of a stirring blade, it is possible to use one which is the same as that in the case of forming a laminar flow in the suspension polymerization method, and it is not restricted in particular provided that a turbulent flow is not formed, but the one formed by a continuous surface such as a square and flat one is preferable, and it may have a curved surface.

In the case of toner used in the invention, it is possible to improve toner characteristics further by using fine particles such as inorganic or organic fine particles, as external additives.

As this inorganic fine particle, the use of particles of inorganic oxide such as silica, titania and alumina is preferable, and further, it is preferable that these inorganic fine particles have been hydrophobic-processed by silane coupling agents or titanium coupling agents. As an extent of hydrophobic processing, it is not limited in particular, but the one with methanol wetability of 40–95 is preferable. The methanol wetability is one to evaluate wettability for methanol. In this method, 0.2 g of inorganic fine particles to be measured is measured and added to 50 ml of distilled water in a beaker with capacity of 200 ml. Methanol is dropped slowly, under the state of slow stirring, from buret whose tip is dipped in a liquid, until the whole of inorganic fine particles are wetted. When "a" (ml) represents an amount of methanol needed to wet the inorganic fine particles completely, a degree of hydrophobicity is calculated by the following expression.

$$\text{Degree of hydrophobicity}=(a/(a+50))\times 100$$

An amount of the external additives to be added is 0.1–5.0% by weight in toner, and it preferably is 0.5–4.0% by weight. Various external additives may also be used in combination.

Fatty acid metal salt may also be added to toner used in the invention as additives. As fatty acid and its metal salt, there are given long-chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid and arachidonic acid, and as its metal salt, a salt with metal such as zinc, iron, magnesium, aluminum, calcium, sodium or lithium can be given. In the invention, zinc stearate is especially preferable.

To prepare two-component developing agents, toner and carrier are mixed for preparation. As toner density for the developing agent, toner is mixed to the density of 2–10% by weight to be used.

There is no restriction, in particular, for a developing method wherein toner that is used in the invention can be used, and it is possible to use either a contact developing method wherein developing is carried out under the condition that a layer of developing agents is in contact with the surface of photoreceptor 121 at the developing area, or a non-contact developing method wherein a layer of developing agents is kept to be away from the surface of photoreceptor 121 at the developing area, and toner is made by alternating electric field to fly through a clearance between the surface of photoreceptor 121 and the layer of developing agents for development.

EXAMPLE

There will be explained as follows the examples of the invention to which, however, the invention is not limited. Incidentally, the expression "parts" in the following means "parts by weight".

Preparation of a Photoreceptor

Polyamide resin Amilan "CM-8000" (made by Toray Industries, Inc.) of 30 g was put in the mixed solvent including 900 ml of methanol and 100 ml of 1-butanol, and heated at 50° C. to be dissolved. This liquid was coated on a cylindrical and conductive support made of aluminum having an outside diameter of 80 mm and a length of 360 mm to form an intermediate layer having a thickness of 0.5 $\mu$m.

Then, silicone resin "KR-5240" (made by Shin-Etsu Chemical Co.) of 10 g was dissolved in 1000 ml of acetic acid t-butyl, to which, 10 g of Y-TiOPc (see TOKKAISHO No. 64-17066) was mixed to be dispersed for 20 hours by the use of a sand mill, and thus, a coating liquid for a charge generating layer was obtained. This liquid was coated on the intermediate layer, and a charge generating layer having a thickness of 0.3 was formed.

Next, as a charge transport material (CTM), 150 g of N-(4-methyl phenyl)-N-{4-(β-phenyl styryl) phenyl}-p-toluidine) and 200 g of polycarbonate resin of viscosity average molecular weight 50000 "TS-2050" (made by Teijin Chemicals Ltd.) were dissolved in 1000 ml of 1,2-dichloroethane, and a coating solution for a charge transport layer was obtained. After coating on the charge transport layer with a circular slide hopper by using the aforesaid coating solution, drying was carried out at 100° C. for one our to form a charge transport layer having a thickness of 22 $\mu$m, thus, there was prepared an organic photoreceptor having a function-separated structure wherein an intermediate layer, a charge generation layer and a charge transport layer are laminated in this order on the surface of a conductive support.

Example of Manufacturing Toner (Example of Emulsion Polymerization Method)

There were poured 0.90 kg of n-dodecyl sodium sulfate and 10.0 liters of pure water, and they were stirred and dissolved. To this solution, there was added slowly 1.20 kg of Regal 330R (carbon black made by Cabot Co.), and after stirring sufficiently for one hour, a sand grinder (homogenizer of a medium type) was used to disperse continuously for 20 hours. Let it be assumed that this solution is "Colorant dispersing solution 1".

Further, a solution composed of 0.055 kg of dodecyl sodium benzenesulfonic and 4.0 liters of ion-exchange water is assumed to be "Anion surfactant solution A".

A solution composed of 0.014 kg of nonylphenol polyethylene oxide 10 mol adduct and 4.0 liters of ion-exchange water is assumed to be "Nonion surfactant solution B".

A solution wherein 223.8 g of potassium persulfate is dissolved in 12.0 liters of ion-exchange water is assumed to be "Initiator solution C".

In a 100-liter GL (glass lining) reaction vessel equipped with a temperature sensor, a cooling pipe and a nitrogen introducing device, there were poured 3.41 kg of WAX emulsion (polypropylene emulsion of number average molecular weight: number average primary particle diameter=120 nm/solid matters density=29.9%), the whole of "Anion surfactant solution A" and the whole of "Nonion surfactant solution B", and stirring was initiated. Then, 44.0 liters of ion-exchange water was added.

Heating was started, and when the solution temperature was raised to 75° C., the whole of "Initiator solution C" was added. After that, 12.1 kg of styrene, 2.88 kg of acrylic acid n-butyl, 1.04 kg of methacrylic acid and 548 g of t-dodecyl mercaptan were added through dropping, while keeping the solution temperature at 75° C.±1° C. After completion of the dropping, the solution temperature was raised to 80° C.±1° C., and heating and stirring were carried out for six hours. Then, the solution temperature was lowered to 40° C. or lower and stirring was stopped to obtain latex after filtering with pole-filter. This is assumed to be "Latex A".

Incidentally, the glass transition temperature of a resin particle in latex A was 57° C., a softening point was 121° C., weight average molecular weight was 12,700 in terms of molecular weight distribution, and weight average particle diameter was 120 nm.

Further, a solution wherein 0.055 kg of dodecyl sodium benzenesulfonic is dissolved in 4.0 liters of ion-exchange water is assumed to be "Anion surfactant solution D".

A solution wherein 0.014 kg of nonylphenol polyethylene oxide 10 mol adduct is dissolved in 4.0 liters of ion-exchange water is assumed to be "Nonion surfactant solution E".

A solution wherein 200.7 g of potassium persulfate (made by Kanto Kagaku Co.) is dissolved in 12.0 liters of ion-exchange water is assumed to be "Initiator solution F".

In a 100-liter GL (glass lining) reaction vessel equipped with a temperature sensor, a cooling pipe, a nitrogen introducing device and a comb-shaped baffle, there were poured 3.41 kg of WAX emulsion (polypropylene emulsion of number average molecular weight: number average primary particle diameter=120 nm/solid matters density=29.9%), the whole of "Anion surfactant solution D" and the whole of "Nonion surfactant solution E", and stirring was initiated.

Then, 44.0 liters of ion-exchange water was added. Heating was started, and when the solution temperature was raised to 70° C., "Initiator solution F" was added. Then, a solution wherein 11.0 kg of styrene, 4.00 kg of acrylic acid n-butyl, 1.04 kg of methacrylic acid and 9.02 g of t-dodecyl mercaptan were mixed in advance was dropped. After completion of the dropping, the solution temperature was controlled to 72° C.±2° C., and heating and stirring were carried out for six hours. The solution temperature was further raised to 80° C.±2° C. and heating and stirring were conducted for 12 hours. The solution temperature was lowered to 40° C. or lower and stirring was stopped. Filtering was conducted with pole-filter, and this filtered solution was assumed to be "Latex B".

Incidentally, the glass transition temperature of a resin particle in latex B was 58° C., a softening point was 132° C., weight average molecular weight was 245000 in terms of molecular weight distribution, and weight average particle diameter was 110 nm.

A solution wherein 5.36 kg of sodium chloride representing a salting-out agent is dissolved in 20.0 liters of ion-exchange water is assumed to be "Sodium chloride solution G".

A solution wherein 1.00 g of fluorine Nonion surfactant is dissolved in 1.00 liter of ion-exchange water is assumed to be "Nonion surfactant solution H".

In a 100-liter SUS reaction vessel (reaction apparatus having the structure shown in FIG. 13, crossed axes angle $\alpha$ is 20°) equipped with a temperature sensor, a cooling pipe, a nitrogen introducing device and a monitoring apparatus for a particle diameter and a form, there were poured 20.0 kg of latex A prepared in the way stated above, 5.2 kg of latex B, 0.4 kg of coloring agent dispersed solution and 20.0 kg of ion-exchange water, and they were stirred. Then, the solution was heated to 40° C., and sodium chloride solution G, 6.00 kg of isopropanol (made by Kanto Kagaku Co.) and Nonion surfactant solution H were added to the solution in this order. After that, they were left for 10 minutes, then, raising temperature was started and continued for 60 minutes until the solution temperature reached 85° C. The solution was heated and stirred for salting-out and fusion to allow a particle diameter to grow, while keeping the temperature of 85° C.±2° C. Then, 2.1 liters of pure water was added to stop the growth of the particle diameter.

In a 5-liter reaction vessel (reaction apparatus having the structure shown in FIG. 13, crossed axes angle $\alpha$ is 20°) equipped with a temperature sensor, a cooling pipe and a monitoring apparatus for a particle diameter and a form, there was poured 5.0 kg of fusion particle dispersed solution prepared in the aforesaid way, and the solution was heated and stirred for 0.5–15 hours at the solution temperature of 85° C.±2° C. so that the form may be controlled. After that, the solution was cooled down to 40° C. or lower and stirring was stopped. Then, classification was conducted in the solution by a centrifugal sedimentation method by using a centrifuge, and filtering was conducted with a filter having a mesh of 4.5 $\mu$m, resulting in a filtered solution which is an association solution. Then, wet-cake-shaped non-spherical particles were obtained from the association solution through filtering, by the use of a Nutsche filter. After that, they were washed with ion-exchange water.

These non-spherical particles were dried by a flash-jet drier at air temperature of 60° C., and then, dried by a fluid bed drier at the temperature of 60° C.

In monitoring of the aforementioned salting-out and fusion step and the form controlling process, the shape and the variation coefficient of shape factor were controlled by controlling the number of revolutions for stirring and heating time, and further, the particle diameter and the variation coefficient of the particle size distribution were adjusted by means of the classification in solution, thus, colored particle (toner particle) 1 and colored particle 2 both having shape characteristics and particle size distribution characteristics shown in the following Table 1 were obtained.

For 100 parts by weight of each of the colored particles, 0.4 parts of hydrophobic silica particle having an average particle diameter of 12 nm (R 805: made by Nippon Aerosil Co. LTD.) and 0.6 parts of titania particle (T 805: made by Nippon Aerosil Co. LTD.) were added thereto as external additives, and were mixed for 10 minutes by Henshell mixer at the peripheral speed of 40 m/sec of a stirring blade under the ordinary temperature. Thus, toner T1 and toner T2 both with property of negative electrification were obtained.

TABLE 1

| | Colored particle | Number average particle diameter D | Rate of toner particles having shape factor 1.2–1.6 | Variation coefficient of shape factor | Rate of toner particles having no corner | Number variation coefficient of number particle size distribution | Sum (M) of toner particles for the maximum frequency (ml) and second frequency (m2) |
|---|---|---|---|---|---|---|---|
| Toner 1 | Colored particle 1 | 6.4 | 76.6 | 12 | 53 | 22 | 77.0 |
| Toner 2 | Colored particle 2 | 6.3 | 92.5 | 8 | 89.5 | 10 | 79.2 |

Preparation of Developing Agent

Ferrite carrier which is covered with silicone resin and has a volume average particle diameter of 60 $\mu$m was mixed with each of the toner T1 and toner T" obtained in the aforementioned way, and developing agents 1 and 2 each having toner density of 5% were prepared.

Example 1

Cleaning device (200) was made in accordance with the structure shown in FIG. 2.

Free length a of cleaning blade (220), protruded length b of vibration-damping member (222), length W2 of tab section (222A) in the axial direction, depth d of slit (224) and gluing condition between the tip end portion of the vibration-damping member (222) and the cleaning blade (220) were established in accordance with the following Table 2.

As cleaning blade (220), there was used one which is made of urethane rubber, and has an impact resilience modulus of 60% (25° C.), JIS A hardness of 70°, a thickness of 2.00 mm, protruded length a of 10 mm and length W1 in the lateral direction of 324 mm (made by Hokushin Kogyo Co.).

As vibration-damping member (222), there was used one which is laminal and is made of polyethylene terephthalate and has a thickness of 0.1 mm, length of 344 mm in the lateral direction and bending strength of 10 N/mm$^2$ (flexibility).tip end portion The cleaning blade (220) was arranged so that a tangential angle (θ) of the cleaning blade to photoreceptor (121) may be 20°, and a contact load on the photoreceptor (121) was set to 25 N/m.

TABLE 2

| | Conditions to be set | | | | | |
|---|---|---|---|---|---|---|
| | Free length a | Free length b | b/a | State of tip portion of vibration-damping member | W2 (mm) | d (mm) |
| Example 1 | 9 | 6.3 | 0.7 | Free end | 8 | 6 |
| Comparative Example 1 | 9 | 6.3 | 0.7 | Free end | 344 | 0 |
| Comparative Example 2 | 9 | 6.3 | 0.7 | Glued | 8 | 6 |

TABLE 2-continued

| | Conditions to be set | | | | | |
|---|---|---|---|---|---|---|
| | Free length a | Free length b | b/a | State of tip portion of vibration-damping member | W2 (mm) | d (mm) |
| Reference Example 1 | 9 | 6.3 | 0.7 | Free end | 2 | 6 |
| Reference Example 2 | 9 | 6.3 | 0.7 | Free end | 61 | 6 |
| Reference Example 3 | 9 | 6.3 | 0.7 | Free end | 8 | 0.5 |
| Reference Example 4 | 9 | 6.3 | 0.7 | Free end | 8 | 7 |

Practical Picture Test

Practical picture tests were made by using the developing agent 1 obtained in the aforesaid way and by using the digital copying machine "Konica 7050" (made by Konica Corporation) equipped with aforementioned organic photoreceptor and cleaning device, and thereby, presence of occurrence of blade eversion, blade squeaking, blade bound and slipping-through of toner was investigated, and images thus formed were evaluated. Results are shown in the following Table 3.

Image Forming Conditions

Initial charging voltage of a charging unit composed of a scorotron charger; −750 V Voltage on exposure section on a surface of photoreceptor; −50 V DC bias; −550 V Dsd (Closest distance between a surface of photoreceptor and a surface of developing sleeve; 550 $\mu$m Regulation of developing agent layer; Regulation blade system Developing agent layer thickness; 700 $\mu$m Developing sleeve diameter; 40 mm Transfer dummy current value on transfer electrode of a corona charging system; 45 $\mu$A Evaluation Method With regard to ambiences for the tests, continuous copying was conducted for 90 minutes under the ambience of ordinary temperature and ordinary humidity (temperature 20° C., relative humidity 50 RH %), then, continuous copying was conducted for 90 minutes under the ambience of high temperature and high humidity (temperature 30° C., relative humidity 80 RH %), and further, continuous copying was conducted for 90 minutes after leaving for one night under the ambience of low temperature and low humidity (temperature 10° C., relative humidity 20 RH %).

Blade Eversion

Presence of occurrence of blade eversion was evaluated.

A: No blade eversion was observed.

C: Blade eversion was observed.

Blade Squeaking

Presence of occurrence of abnormal sound caused by abnormal friction between the cleaning blade and the photoreceptor was evaluated.

A: No occurrence of abnormal sound.

C: Occurrence of abnormal sound was observed.

Blade Bound

Halftone images were formed as a first image after leaving for one night under the ambience of low temperature and low humidity, and lateral streaks on these images (marks of blade bounding) were observed.

A: No streaks on images.

C: Streaks were observed on images.

CC: Streaks were especially conspicuous on images.

Image Evaluation

Presence of occurrence of image unevenness and image smudges caused by blade eversion, blade bound and slipping-through of toner was observed.

A: No occurrence of image failure.

C: Not suitable for practical use with occurrence of image failure.

TABLE 3

| | Presence of occurrence of blade eversion | | | Presence of occurrence of blade squeaking | | |
|---|---|---|---|---|---|---|
| Ambient conditions | Low temperature and low humidity | Ordinary temperature and ordinary humidity | High temperature and high humidity | Low temperature and low humidity | Ordinary temperature and ordinary humidity | High temperature and high humidity |
| Example 1 | A | A | A | A | A | A |
| Comparative Example 1 | A | A | A | A | A | A |
| Comparative Example 2 | A | A | C | A | A | C |
| Reference Example 1 | A | A | A | A | A | A |
| Reference Example 2 | A | A | A | A | A | A |
| Reference Example 3 | A | A | A | A | A | A |
| Reference Example 4 | A | A | A | A | A | A |

| | Presence of occurrence of blade bound | | | Image evaluation | | |
|---|---|---|---|---|---|---|
| Ambient conditions | Low temperature and low humidity | Ordinary temperature and ordinary humidity | High temperature and high humidity | Low temperature and low humidity | Ordinary temperature and ordinary humidity | High temperature and high humidity |
| Example 1 | A | A | A | A | A | A |
| Comparative Example 1 | CC | A | A | C | A | A |
| Comparative Example 2 | CC | C | A | C | C | C |
| Reference Example 1 | A | A | A | A | A | A |
| Reference Example 2 | C | A | A | A | A | A |
| Reference Example 3 | C | A | A | A | A | A |
| Reference Example 4 | A | A | A | A | A | A |

As stated above, it was confirmed that sufficiently high cleaning effect was surely exhibited without being affected by the ambience and images with high image quality can be formed stably in the image forming apparatus of the invention relating to Example 1.

On the contrary, in the image forming apparatus relating to Comparative Example 1 having no tab portions on vibration-damping member in the cleaning device and to Reference Example 2 having a tab with great width W2, occurrence of blade bound was conspicuous under the ambient of low temperature and low humidity, and in the image forming apparatus relating to Comparative Example 2 wherein the tip portion of the vibration-damping member is glued with the cleaning blade, it was confirmed that some sort of cleaning failure occurs under any ambient circumstances, and it is difficult to form stably the images with high image quality, which is not suitable for practical use. Further, in the Reference Example 3 wherein depth "d" of a slit in the tab portion is less than 1/10 of length "b" of the protruded portion, blade bound occurred, which was not preferable.

Example 2

Cleaning device (200) was made in accordance with the structure shown in FIG. 4.

Free length a of cleaning blade (220), protruded length b of vibration-damping member (222), length W2 of tab section (222A) in the axial direction, depth d of slit (223) and gluing condition between the tip end portion of the vibration-damping member (222) and the cleaning blade (220) were established in accordance with the following Table 4.

As cleaning blade (220), there was used one which is made of urethane rubber, and has an impact resilience modulus of 60% (25° C.), JIS A hardness of 70°, a thickness of 2.00 mm, protruded length a of 10 mm and length W1 in the lateral direction of 324 mm (made by HOKUSHIN CORPORATION).

As vibration-damping member (222), there was used one which is laminal and is made of polyethylene terephthalate and has a thickness of 0.1 mm, a length of 344 mm in the lateral direction and bending strength of 100 N/mm$^2$ (flexibility).

The cleaning blade (220) was arranged so that a tangential angle (θ) of the cleaning blade to photoreceptor (121) may be 20°, and a contact load on the photoreceptor (121) was set to 25 N/m.

As cleaning roller (210), there was used one which was made of conductive foam urethane and had Ascar C hardness of 30° and had surface resistance of $10^4$ Ωcm. Cleaning roller (210) drives to rotate so that a portion of contact with photoreceptor (121) may be moved in the same direction as a moving direction of photoreceptor (121), and linear speed ratio (Vr/Vp) of linear speed (Vr) of cleaning roller (210) to linear speed (Vp) of photoreceptor (121) was set to 1.05.

Further, a nip width between cleaning roller (210) and photoreceptor (121) was set to 2 mm and a value of electric current impressed by bias voltage impressing means (211) composed of a constant current power supply was set to +20 μA.

Practical Picture Test

Practical picture tests were made by using the developing agent 1 and the developing agent 2 and by using the digital copying machine "Konica 7050" (made by Konica Corporation) equipped with aforementioned organic photoreceptor and cleaning device, and thereby, presence of occurrence of blade eversion, slipping-through of toner, blade squeaking and blade bound was investigated, and images thus formed were evaluated. Results are shown in the following Table 5.

Image Forming Conditions

Initial charging voltage of a charging unit composed of a scorotron charger; −750 V Voltage on exposure section on a surface of photoreceptor; −50 V DC bias; −550 V Dsd (Closest distance between a surface of photoreceptor and a surface of developing sleeve; 550 μm Regulation of developing agent layer; Edge cut system Developing agent layer thickness; 700 μm Developing sleeve diameter; 40 mm Transfer dummy current value on transfer electrode of a corona charging system; 45 μA Evaluation Method With regard to ambiences for the tests, continuous copying was conducted for 90 minutes under the ambience of ordinary temperature and ordinary humidity (temperature 20° C., relative humidity 50 RH %), then, continuous copying was conducted for 90 minutes under the ambience of high temperature and high humidity (temperature 30° C., relative humidity 80 RH %), then further, continuous copying was conducted for 90 minutes after leaving for one night under the ambience of low temperature and low humidity (temperature 10° C., relative humidity 20 RH %), and

TABLE 4

| | | Conditions to be set | | | | | |
|---|---|---|---|---|---|---|---|
| | Toner | Free length a | Free length b | b/a | State of tip portion of vibration-damping member | W2 (mm) | d (mm) |
| Example 1 | T1 | 9 | 6.3 | 0.7 | Free end | 8 | 6 |
| Example 2 | T2 | 9 | 6.3 | 0.7 | Free end | 8 | 6 |
| Comparative Example 1 | T1 | 9 | 6.3 | 0.7 | Free end | 344 | 0 |
| Comparative Example 2 | T1 | 9 | 6.3 | 0.7 | Glued | 2 | 6 |

continuous copying was conducted for 30 minutes under the ambience of extremely low temperature (temperature 0° C., relative humidity 10 RH %).

Blade Eversion

Presence of occurrence of blade eversion was evaluated.

A: No blade eversion was observed.

C: Blade eversion was observed.

Slipping-through of Toner

A: No Slipping-through of residual toner.

B: Residual toner slipped through is less than 20%.

C: Residual toner slipped through is not less than 20% and is less than 50%.

CC: Residual toner slipped through is not less than 50%.

Blade Squeaking

Presence of occurrence of abnormal sound caused by abnormal friction between the cleaning blade and the photoreceptor was evaluated.

A: No occurrence of abnormal sound.

C: Occurrence of abnormal sound was verified.

Blade Bound

Halftone images were formed as a first image after leaving for one night under the ambience of low temperature and low humidity, and lateral streaks on these images (marks of blade bounding) were observed.

A: No streaks on images.

C: Streaks were observed on images.

CC: Streaks were especially conspicuous on images.

Image Evaluation

Presence of occurrence of image unevenness and image smudges caused by blade eversion, blade bound and slipping-through of toner was observed. The symbol "A" shows an extremely excellent occasion having no occurrence of image failure, and "C" shows an occasion that is not suitable for practical use with occurrence of image failure.

As stated above, it was confirmed that sufficiently high cleaning effect was surely exhibited without being affected by the ambience and images with high image quality can be formed stably in the image forming apparatus of the invention relating to Example 1.

On the contrary, in the image forming apparatus relating to Comparative Example 1 having no tab portions on vibration-damping member in the cleaning device, occurrence of blade bound was conspicuous under the ambient of low temperature and low humidity, and in the image forming apparatus relating to Comparative Example 2 wherein the tip portion of the vibration-damping member is glued with the cleaning blade, it was confirmed that some sort of cleaning failure occurs under any ambient circumstances, and it is difficult to form stably the images with high image quality.

Effect of the Invention

In the cleaning device of the invention, an effect of cleaning that is basically high is exhibited and residual toner on a latent image carrier can surely be removed accordingly, because electrostatic cleaning by a cleaning roller mechanism as well as mechanical cleaning by a cleaning blade mechanism are conducted.

Further, in the cleaning blade mechanism, a vibration-damping member touches a cleaning blade to cover its whole length in its width direction without regulating elastic deformation of the cleaning blade. Therefore, a vibration of the cleaning blade is damped by the vibration-damping member to be inhibited small, and each tab portion can exhibit its vibration-damping function independently of others, thus, occurrence of blade bound, blade eversion, blade squeaking or slipping-through of toner can surely be prevented, and high cleaning effect can surely be exhibited.

Further, even in the case of variation of pressing force of the cleaning blade against a latent image carrier caused by deformation of the cleaning blade that results from environmental fluctuations, the vibration-damping member follows the cleaning blade, and thereby, occurrence of great varia-

TABLE 5

| | Presence of occurrence of blade eversion | | | Presence of occurrence of slipping-through | | | |
|---|---|---|---|---|---|---|---|
| Ambient conditions | Low temperature and low humidity | Ordinary temperature and ordinary humidity | High temperature and high humidity | Extremely low temperature | Low temperature and low humidity | Ordinary temperature and ordinary humidity | High temperature and high humidity |
| Example 1 | A | A | A | A | A | A | A |
| Example 2 | A | A | A | A | A | A | A |
| Comparative Example 2 | A | A | A | B | A | A | A |
| Comparative Example 2 | A | A | C | CC | CC | A | B |

| | Presence of occurrence of blade squeaking | | | Presence of occurrence of blade bound | | | Image evaluation | | |
|---|---|---|---|---|---|---|---|---|---|
| Ambient conditions | Low temperature and low humidity | Ordinary temperature and ordinary humidity | High temperature and high humidity | Low temperature and low humidity | Ordinary temperature and ordinary humidity | High temperature and high humidity | Low temperature and low humidity | Ordinary temperature and ordinary humidity | High temperature and high humidity |
| Example 1 | A | A | A | A | A | A | A | A | A |
| Example 2 | A | A | A | A | A | A | A | A | A |
| Comparative Example 2 | A | A | A | CC | A | A | C | A | A |
| Comparative Example 2 | A | A | C | CC | C | A | C | C | C |

tion of contact load of the cleaning blade against the latent image carrier is repressed, thus, occurrence of blade bound, blade eversion, blade squeaking or slipping-through of toner can be prevented surely, and expected cleaning effect can be exhibited stably despite the environmental fluctuations.

In the image forming apparatus of the invention wherein the aforementioned cleaning device is provided, it is possible to prevent surely occurrence of blade squeaking, blade bound or blade eversion, and to exhibit stable cleaning effect for environmental fluctuations, and therefore, it is possible to remove residual toner on the latent image carrier for certain, and to form stably images having high image quality for a long time.

What is claimed is:

1. A cleaning device for cleaning a toner from a surface of a cylindrical latent image carrier driven to rotate, comprising:

a cleaning blade arranged so that a tip edge portion on a first surface of the cleaning blade contacts with the surface of the cylindrical latent image carrier;

a supporting member for supporting the cleaning blade, and for urging the cleaning blade to contact with the surface of the cylindrical latent image carrier, the supporting member having a first surface facing a second surface opposite to the first surface of the cleaning blade; and a laminar vibration-damping member interposed between the cleaning blade and the support member, and extending beyond the support member onto the second surface of the cleaning blade;

wherein, the second surface at a base end portion, which is in far side of the tip end portion, of the cleaning blade is fixed to the surface of the supporting member via the laminar vibration-damping member;

wherein, at a tip end portion of the vibration-damping member, which is an extended portion beyond the supporting member onto the second surface of the cleaning blade, a plurality of slits are formed so that a plurality of tab portions are formed to be arranged in the axial direction of the cylindrical latent image carrier.

2. The cleaning device of claim 1, wherein a ratio of a protruded length of the vibration-damping member extending beyond the tip edge of the supporting member to a protruded length of the cleaning blade extending beyond the tip edge of the supporting member is greater than 1/10 and is not more than 9/10.

3. The cleaning device of claim 1, wherein in the axial direction of the cylindrical latent image carrier, a length of the tab portion of the laminar vibration-damping member is within a range of 1/100 to 1/10 of a length of the cleaning blade.

4. The cleaning device of claim 2, wherein a depth of a plurality of slits is within a range of 1/10 to 1/1 of the protruded length of the vibration-damping member.

5. An image forming apparatus comprising:

a cylindrical latent image carrier driven to rotate around an axis;

a toner image forming section to form a toner image on the cylindrical latent image carrier;

a transfer section to transfer the toner image formed on the cylindrical latent image carrier to a transfer sheet; and a cleaning device to remove a residual toner on the cylindrical latent image carrier passed through the transfer section; wherein, the cleaning device comprising:

a cleaning blade arranged so that a tip edge portion on a first surface of the cleaning blade contacts with the surface of the cylindrical latent image carrier;

a supporting member for supporting the cleaning blade, and for urging the cleaning blade to contact with the surface of the cylindrical latent image carrier, the supporting member having a first surface facing a second surface opposite to the first surface of the cleaning blade; and a laminar vibration-damping member interposed between the cleaning blade and the support member, and extending beyond the support member onto the second surface of the cleaning blade;

wherein, the second surface at a base end portion, which is in far side of the tip end portion, of the cleaning blade is fixed to the surface of the supporting member via the laminar vibration-damping member;

wherein, at a tip end portion of the vibration-damping member, which is an extended portion beyond the supporting member onto the second surface of the cleaning blade, a plurality of slits are formed so that a plurality of tab portions are formed to be arranged in the axial direction of the cylindrical latent image carrier.

6. The cleaning device of claim 5, wherein a ratio of a protruded length of the vibration-damping member extending beyond the tip edge of the supporting member to a protruded length of the cleaning blade extending beyond the tip edge of the supporting member is greater than 1/10 and is not more than 9/10.

7. The cleaning device of claim 5, wherein in the axial direction of the cylindrical latent image carrier, a length of the tab portion of the laminar vibration-damping member is within a range of 1/100 to 1/10 of a length of the cleaning blade.

8. The cleaning device of claim 6, wherein a depth of a plurality of slits is within a range of 1/10 to 1/1 of the protruded length of the vibration-damping member.

9. The image forming apparatus of claim 5, wherein the toner image is formed by using a toner comprising toner particles, wherein a percentage of toner particles whose shape factor is within a range of 1.2–1.6 is 65 number % or more, and a variation coefficient of the shape factor is 16% or less.

10. The image forming apparatus of claim 5, wherein the toner image is formed by using a toner comprising toner particles, wherein a variation coefficient of the shape factor is 16% or less, and a number variation coefficient in number particle size distribution is 27% or less.

11. The image forming apparatus of claim 5, wherein the toner image is formed by using a toner comprising toner particles, wherein a percentage of toner particles having no corners is 50 number % or more.

12. A cleaning device for cleaning a toner from a surface of a cylindrical latent image carrier driven to rotate, comprising:

a cleaning roller mechanism having a cleaning roller arranged so as to touch the surface of the cylindrical latent image carrier and to rotate around the rotary shaft extending in the axial direction of the latent image carrier, and a bias voltage applying device that applies bias voltage on the cleaning roller; and a cleaning blade mechanism provided at downstream side of the cleaning roller in the direction of movement of the cylindrical latent image carrier comprising:

a cleaning blade arranged so that a tip edge portion on a first surface of the cleaning blade contacts with the surface of the cylindrical latent image carrier;

a supporting member for supporting the cleaning blade, and for urging the cleaning blade to contact with the surface of the cylindrical latent image carrier, the supporting member having a first surface facing a second surface opposite to the first surface of the cleaning blade; and a laminar vibration-damping member interposed between the cleaning blade and the support member, and extending beyond the support member onto the second surface of the cleaning blade;

wherein, the second surface at a base end portion, which is in far side of the tip end portion, of the cleaning blade is fixed to the surface of the supporting member via the laminar vibration-damping member;

wherein, at a tip end portion of the vibration-damping member, which is an extended portion beyond the supporting member onto the second surface of the cleaning blade, a plurality of slits are formed so that a plurality of tab portions are formed to be arranged in the axial direction of the cylindrical latent image carrier.

13. The cleaning device of claim 12, wherein a ratio of a protruded length of the vibration-damping member extending beyond the tip edge of the supporting member to a protruded length of the cleaning blade extending beyond the tip edge of the supporting member is greater than 1/10 and is not more than 9/10.

14. The cleaning device of claim 12, wherein in the axial direction of the cylindrical latent image carrier, a length of the tab portion of the laminar vibration-damping member is within a range of 1/100 to 1/10 of a length of the cleaning blade.

15. The cleaning device of claim 13, wherein a depth of a plurality of slits is within a range of 1/10 to 1/1 of the protruded length of the vibration-damping member.

16. The cleaning device of claim 12, wherein the bias voltage applying device is a constant-current power supply.

17. An image forming apparatus comprising:

a cylindrical latent image carrier driven to rotate around an axis;

a toner image forming section to form a toner image on the cylindrical latent image carrier;

a transfer section to transfer the toner image formed on the cylindrical latent image carrier to a transfer sheet; and a cleaning device to remove a residual toner on the cylindrical latent image carrier passed through the transfer section; wherein, the cleaning device comprising:

a cleaning roller mechanism having a cleaning roller that is arranged so as to touch the surface of the cylindrical latent image carrier and to rotate around the rotary shaft extending in the axial direction of the latent image carrier, and a bias voltage applying device that applies bias voltage on the cleaning roller; and a cleaning blade mechanism provided at downstream side of the cleaning roller in the direction of movement of the cylindrical latent image carrier comprising:

a cleaning blade arranged so that a tip edge portion on a first surface of the cleaning blade contacts with the surface of the cylindrical latent image carrier;

a supporting member for supporting the cleaning blade, and for urging the cleaning blade to contact with the surface of the cylindrical latent image carrier, the supporting member having a first surface facing a second surface opposite to the first surface of the cleaning blade; and a laminar vibration-damping member interposed between the cleaning blade and the support member, and extending beyond the support member onto the second surface of the cleaning blade;

wherein, the second surface at a base end portion, which is in far side of the tip end portion, of the cleaning blade is fixed to the surface of the supporting member via the laminar vibration-damping member;

wherein, at a tip end portion of the vibration-damping member, which is an extended portion beyond the supporting member onto the second surface of the cleaning blade, a plurality of slits are formed so that a plurality of tab portions are formed to be arranged in the axial direction of the cylindrical latent image carrier.

18. The image forming apparatus of claim 17, wherein a ratio of a protruded length of the vibration-damping member extending beyond the tip edge of the supporting member to a protruded length of the cleaning blade extending beyond the tip edge of the supporting member is greater than 1/10 and is not more than 9/10.

19. The image forming apparatus of claim 17, wherein in the axial direction of the cylindrical latent image carrier, a length of the tab portion of the laminar vibration-damping member is within a range of 1/100 to 1/10 of a length of the cleaning blade.

20. The image forming apparatus of claim 18, wherein a depth of a plurality of slits is within a range of 1/10 to 1/1 of the protruded length of the vibration-damping member.

21. The image forming apparatus of claim 17, wherein the bias voltage applying device is a constant-current power supply.

22. The image forming apparatus of claim 17, wherein the toner image is formed by using a toner comprising toner particles, wherein a percentage of toner particles whose shape factor is within a range of 1.2–1.6 is 65 number % or more, and a variation coefficient of the shape factor is 16% or less.

23. The image forming apparatus of claim 17, wherein the toner image is formed by using a toner comprising toner particles, wherein a variation coefficient of the shape factor is 16% or less, and a number variation coefficient in number particle size distribution is 27% or less.

24. The image forming apparatus of claim 17, wherein the toner image is formed by using a toner comprising toner particles, wherein a percentage of toner particles having no corners is 50 number % or more.

* * * * *